US011330910B2

(12) United States Patent
Collett

(10) Patent No.: US 11,330,910 B2
(45) Date of Patent: May 17, 2022

(54) BED ASSEMBLY WITH FOAM-BASED HEADBOARD HAVING READILY INTERCHANGEABLE OUTER COVERINGS

(71) Applicant: Coley LLC, Charlotte, NC (US)

(72) Inventor: Coley Ruffin Collett, Charlotte, NC (US)

(73) Assignee: COLEY LLC, Charlotte, NC (US)

( * ) Notice: Subject to any disclaimer, the term of this patent is extended or adjusted under 35 U.S.C. 154(b) by 5 days.

(21) Appl. No.: 17/007,645

(22) Filed: Aug. 31, 2020

(65) Prior Publication Data

US 2021/0059421 A1 Mar. 4, 2021

Related U.S. Application Data

(60) Provisional application No. 62/893,878, filed on Aug. 30, 2019.

(51) Int. Cl.
*A47C 19/02* (2006.01)
*A47C 19/00* (2006.01)

(52) U.S. Cl.
CPC ..... *A47C 19/022* (2013.01); *A47C 19/024* (2013.01); *A47C 19/025* (2013.01); *A47C 19/005* (2013.01)

(58) Field of Classification Search
CPC ... A47C 19/022; A47C 19/024; A47C 19/005; A47C 19/02; A47C 31/10; A47C 20/027; A61G 7/0506; F16B 12/46
See application file for complete search history.

(56) References Cited

U.S. PATENT DOCUMENTS 1,651,430 A * 12/1927 Wittliff ..... F16B 12/46 248/188.91
3,148,390 A * 9/1964 Vakousky ..... A47C 27/146 441/127
5,195,195 A * 3/1993 Murray ..... A47C 19/022 5/406

(Continued)

FOREIGN PATENT DOCUMENTS

GB 2130878 A * 6/1984 ..... A47C 19/022

*Primary Examiner* — Robert G Santos
*Assistant Examiner* — Alison N Labarge
(74) *Attorney, Agent, or Firm* — Shumaker, Loop & Kendrick, LLP

(57) ABSTRACT

A bed assembly including (a) a foam headboard having a protective outer covering positioned thereon; (b) one or more slip covers configured to be positioned on the foam headboard, each slip cover having a releasable fastening mechanism to temporarily securely position the slip cover on the foam head board; and (c) a bed frame assembly including (i) a plurality of legs, (ii) a plurality of side rails that are configured to be positioned and securely fastened between two separate legs of the plurality of legs; (iii) a plurality of securing brackets, each bracket configured to be positioned on the securing member of each leg, to concurrently grip two separate side rails, and to securely fasten the separate side rails to the leg by biasing the securing bracket in a direction towards the exterior of the bed frame assembly when assembled; and (iv) a support beam configured to be positioned within the interior of the bed frame assembly when the bed frame assembly is assembled.

6 Claims, 29 Drawing Sheets

(56) References Cited

U.S. PATENT DOCUMENTS

| | | | | |
|---|---|---|---|---|
| 5,530,974 | A * | 7/1996 | Rains | A47C 21/08 5/630 |
| 2008/0078022 | A1* | 4/2008 | Wecker | A47C 19/021 5/1 |
| 2009/0293198 | A1* | 12/2009 | Fodge | A47C 31/10 5/653 |
| 2010/0325801 | A1* | 12/2010 | Tucker | A47C 19/022 5/636 |
| 2014/0175236 | A1* | 6/2014 | Nguyen | F16B 12/46 248/163.1 |
| 2017/0042336 | A1* | 2/2017 | Craver | A47B 88/40 |
| 2020/0037772 | A1* | 2/2020 | Schachter | A47C 19/021 |

* cited by examiner

BED ASSEMBLY WITH FOAM-BASED HEADBOARD HAVING READILY INTERCHANGEABLE OUTER COVERINGS

TECHNICAL FIELD

The present invention relates generally to the field of beds and bed assemblies, and more particularly, to bed assemblies with foam-based headboard(s) that have easily interchangeable outer coverings to quickly vary headboard appearance as aesthetically desired and/or as needed due to wear and tear.

BACKGROUND

Bed assemblies and bed frames/bed frame assemblies have made drastic improvements in ease of assembly over the past several decades. However, mid-grade and high quality bed assemblies, bed frames, and bed frame assemblies remain quite difficult to assemble—often requiring specialized tools and multiple people when assembling the various parts. Furthermore, most (if not all) mid-grade and high quality bed assemblies are quite heavy, cumbersome, and cannot easily be re-purposed without an expensive and lengthy re-upholstering process. Thus, many problems remain with mid-grade and high quality bed assemblies, and a need exists to provide a solution to these numerous problems.

SUMMARY

Disclosed herein are easy to assemble bed assemblies that are lightweight, can be assembled in a matter of minutes, and can be further quickly re-purposed (e.g., with a different slip cover) within seconds and/or minutes. These bed assemblies include foam and/or foam-based headboard(s) that have easily interchangeable outer coverings to vary the headboard appearance as aesthetically desired and/or as needed due to wear and tear.

More specifically disclosed are bed assemblies including: (a) a foam headboard having a protective outer covering positioned thereon; (b) one or more slip covers configured to be positioned on the foam headboard, each slip cover having a releasable fastening mechanism to temporarily securely position the slip cover on the foam head board and having a pocket that conceals portions of the fastening mechanism when the slip cover is positioned on the foam head board; and (c) a bed frame assembly, the bed frame assembly including: (i) a plurality of legs, each leg having a first side and second side that are each configured to securely attach to separate side rails and each leg having a securing member positioned on a corner of the leg between the first side and second side of the leg that extends away from the leg towards the interior of the bed frame assembly when assembled; (ii) a plurality of side rails that are configured to be positioned and securely fastened between two separate legs of the plurality of legs; (iii) a plurality of securing brackets, each bracket configured to be positioned on the securing member of each leg, to concurrently grip two separate side rails and securely fasten the separate side rails to the leg by biasing the securing bracket in a direction towards the exterior of the bed frame assembly when assembled; and (iv) a support beam configured to be completely positioned within the interior of the bed frame assembly between two separate side rails when the bed frame assembly is assembled to provide further support and rigidity to the bed frame assembly and to further support a mattress when positioned on the assembled bed frame assembly.

In certain aspects, the foam headboard of the bed assembly includes a polyurethane foam.

In certain aspects, the polyurethane foam of the foam headboard of the bed assembly includes at least one of a castable polyurethane or a thermoplastic polyurethane with the proviso that a millable polyurethane is not present. In certain aspects, the polyurethane foam is either a closed cell or open cell foam. In certain aspects, the polyurethane foam has an R-value as a measure of hardness ranging from 1.6 lbs. per cubic foot to 2.1 lbs. per cubic foot at ambient conditions. In certain aspects, the polyurethane foam comprises a compression modulus ranging from 75 lbs. to 80 lbs. at ambient conditions. In certain aspects, the polyurethane foam has a cell density ranging from 1.6 to 1.8 cells/cm$^3$ ($\times 10^{10}$) and more preferably from 1.65 to 1.75 cells/cm$^3$) ($\times 10^{10}$). In certain aspects, the polyurethane foam is a closed cell polyurethane foam. In certain aspects, the foam head board has two spaced apart ends with a plurality of through holes arranged on each of the two spaced apart ends, each through hole of the plurality of through holes are configured to align with and receive posts attached to and extending away from the bed frame assembly therein to securely affix the foam head board to the bed frame assembly.

In a further aspect, the slip cover of the one or more slip covers of the bed assembly includes two spaced apart ends with a plurality of through holes arranged on each of the two spaced apart ends of the slip cover with each through hole of the plurality of through holes of the slip cover configured to align with each through hole of the foam head board such that posts attached to and extending away from the bed frame assembly therein to securely affix the foam head board to the bed frame assembly.

In certain aspects, also disclosed is a kit comprising the above discussed bed assembly. In certain aspects, the kit may further include a mallet, fastening tool(s), and/or fasteners that are configured to fasten the side rails, legs, support beam, and/or securing bracket(s) to one another when assembling the bed frame assembly.

In another aspect, also disclosed is a headboard assembly including: (a) a foam headboard having a protective outer covering positioned thereon; and (b) one or more slip covers configured to be positioned on the foam headboard, each slip cover having a releasable fastening mechanism to temporarily securely position the slip cover on the foam head board and having a pocket that conceals portions of the fastening mechanism when the slip cover is positioned on the foam head board.

In certain aspects, the foam headboard of the headboard assembly comprises a polyurethane foam. In certain aspects, the polyurethane foam is at least one of a castable polyurethane or a thermoplastic polyurethane with the proviso that a millable polyurethane is not present. In certain aspects, the polyurethane foam is either a closed cell or open cell foam. In certain aspects, the polyurethane foam has an R-value as a measure of hardness ranging from 1.6 lbs. per cubic foot to 2.1 lbs. per cubic foot at ambient conditions. In certain aspects, the polyurethane foam comprises a compression modulus ranging from 75 lbs. to 80 lbs at ambient conditions. In certain aspects, the polyurethane foam has a cell density ranging from 1.6 to 1.8 cells/cm$^3$) ($\times 10^{10}$) and more preferably from 1.65 to 1.75 cells/cm$^3$) ($\times 10^{10}$). In certain aspects, the polyurethane foam is a closed cell polyurethane foam. In certain aspects, the foam head board has two spaced apart ends with a plurality of through holes arranged on each of the two spaced apart ends, each through hole of the plurality of through holes are configured to align with and receive posts attached to and extending away from the bed frame assembly therein to securely affix the foam head board to the bed frame assembly.

In a further aspect, a slip cover of the one or more slip covers of the foam headboard assembly comprises two spaced apart ends with a plurality of through holes arranged on each of the two spaced apart ends of the slip cover with each through hole of the plurality of through holes of the slip cover configured to align with each through hole of the foam head board such that posts attached to and extending away from the bed frame assembly therein to securely affix the foam head board to the bed frame assembly.

Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
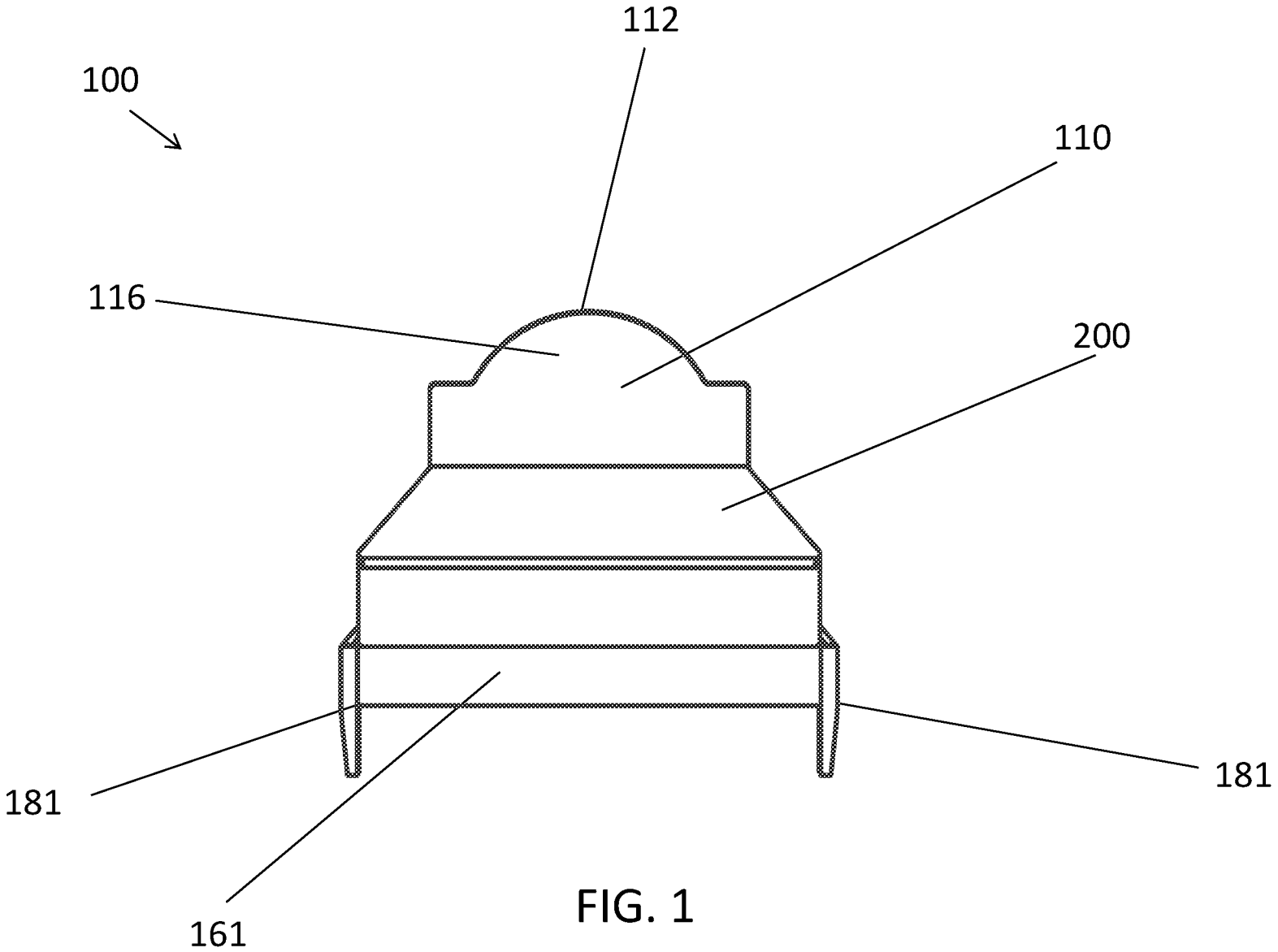
FIG. 1 depicts the fully assembled bed assembly with a mattress positioned thereon.
Figure 2:
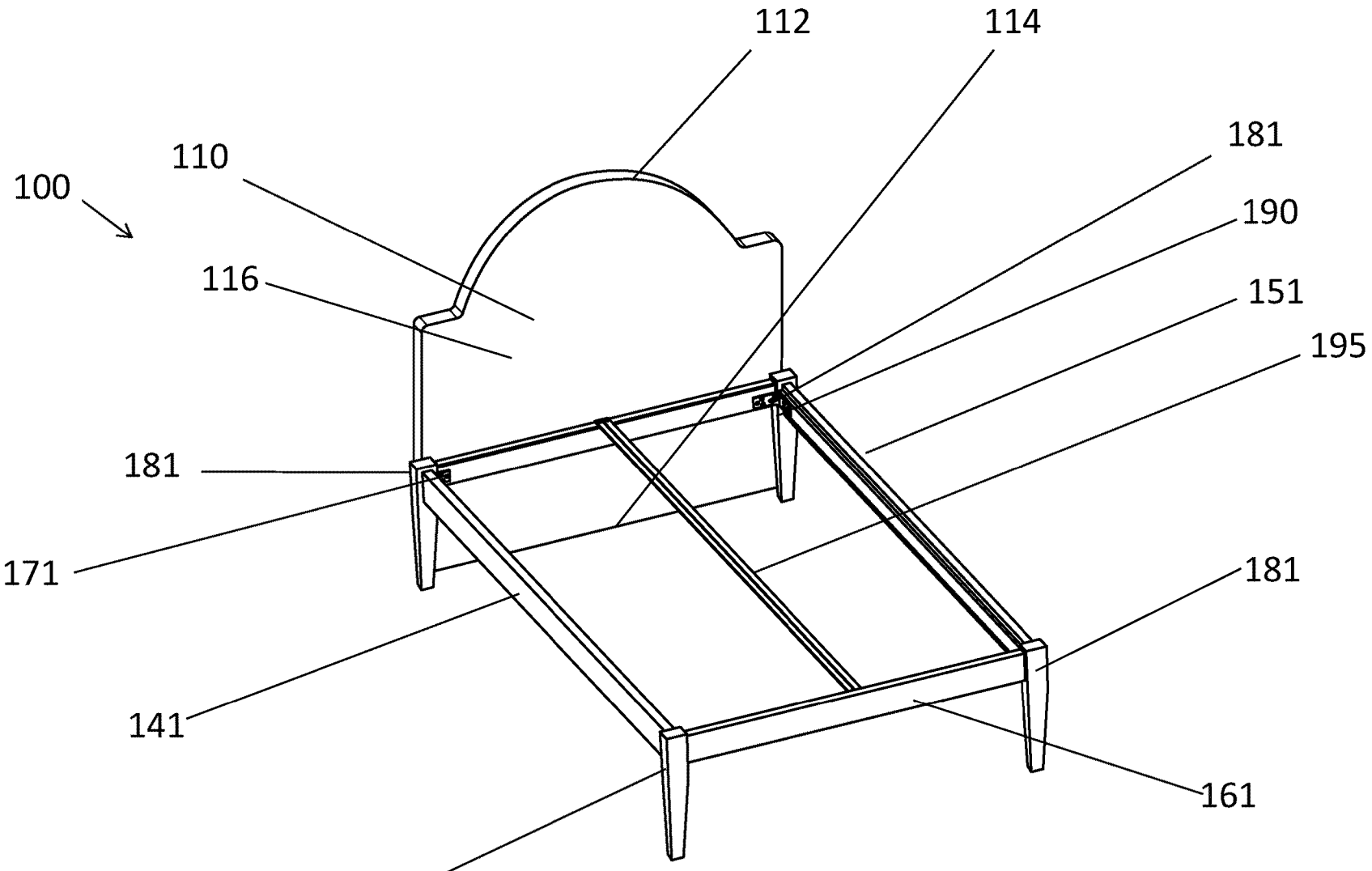
FIG. 2 depicts the fully assembled bed assembly without a mattress positioned thereon.

Disclosed herein are bed assemblies 100 with foam-based headboard(s) 110 that have easily interchangeable coverings (slip covers) to vary the headboard appearance as aesthetically desired and/or as needed due to wear and tear. Specifically shown in FIG. 1 is the assembled bed assembly 100 with a mattress 200 thereon, and FIG. 2 further shows the assembled bed assembly 100 without a mattress positioned thereon.

FIGS. 1, 2, 3A, and 8 specifically depict bed assemblies 100 including: (a) a foam headboard 110 having a protective outer covering 124 positioned thereon; (b) one or more slip covers 130 configured to be positioned on the foam headboard 110, each slip cover 130 having a releasable fastening mechanism 135 to temporarily securely position the slip cover on the foam head board and having a pocket 137 that conceals portions of the fastening mechanism when the slip cover is positioned on the foam head board; and (c) a bed frame assembly 140, the bed frame assembly including: (i) a plurality of legs, each leg 181 having a first side 182 and second side 183 that are each configured to securely attach to separate side rails and each leg having a securing member 185 positioned on a corner of the leg between the first side and second side of the leg that extends away from the leg towards the interior of the bed frame assembly when assembled; (ii) a plurality of side rails 141, 151, 161, 171 that are configured to be positioned and securely fastened between two separate legs of the plurality of legs; (iii) a plurality of securing brackets 191, each bracket 191 configured to be positioned on the securing member of each leg, to concurrently grip two separate side rails, and to securely fasten the separate side rails to the leg by biasing the securing bracket in a direction towards the exterior of the bed frame assembly when assembled; and (iv) a support beam 195 configured to be completely positioned within the interior of the bed frame assembly between two separate side rails when the bed frame assembly 140 is assembled to provide support and rigidity to the bed frame assembly and to further support a mattress when positioned on the assembled bed frame assembly.

Figure 9A:
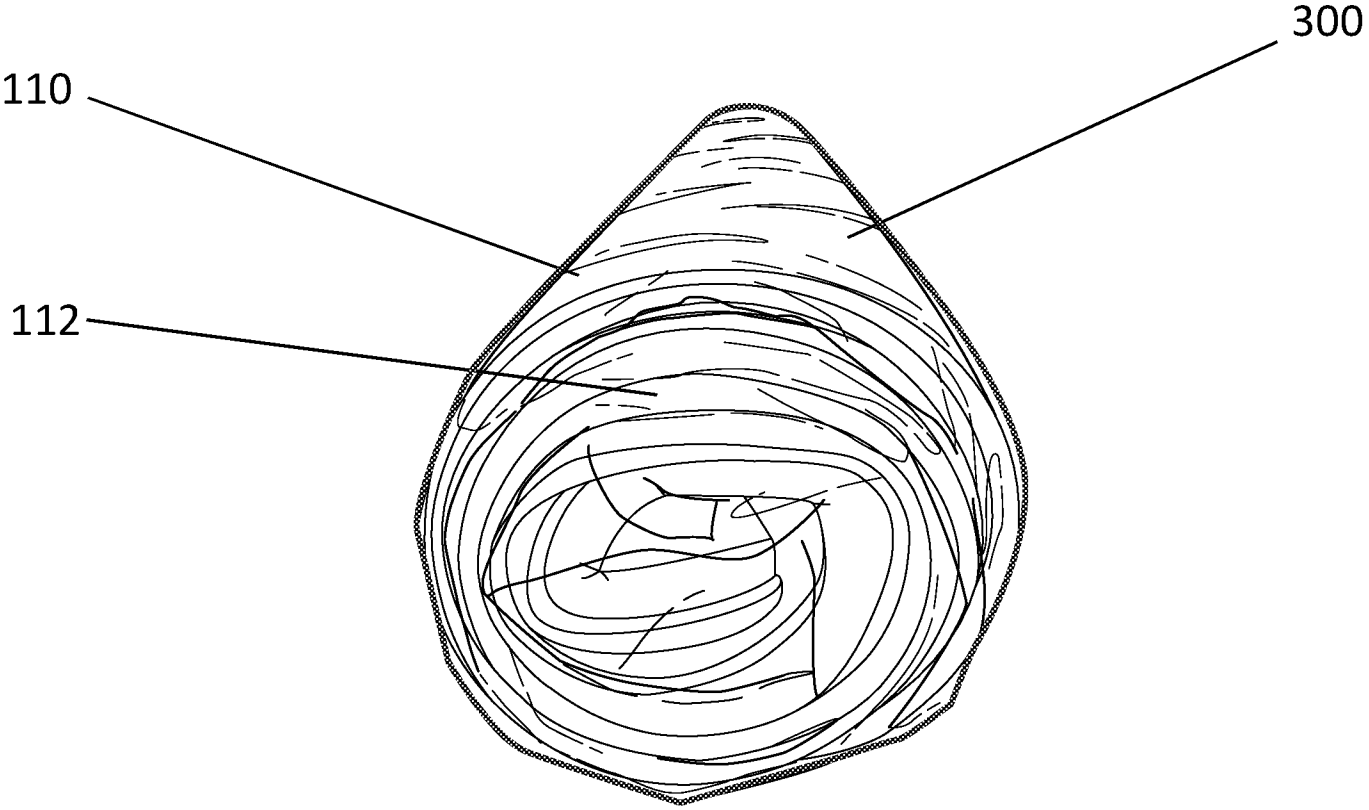
FIGS. 9A and 9B depict two separate views of the foam based headboard within packaging in a rolled and compressed state.
Figure 9B:
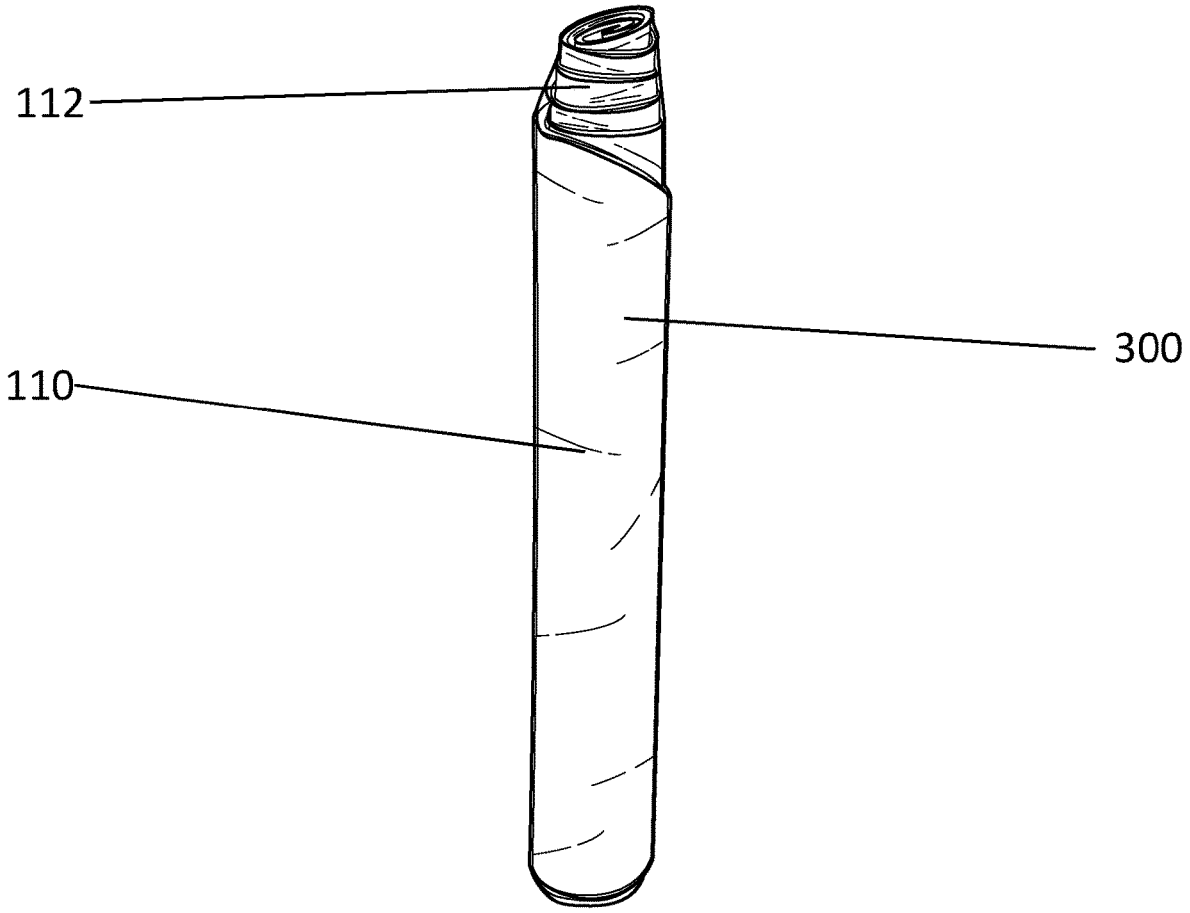

With specific reference to FIGS. 3A-3H, FIGS. 3A-3H sequentially depict positioning and securing a slip cover 130 on the foam based headboard 110. In certain aspects and as specifically shown in FIGS. 3A and 3B, the foam based headboard 110 may be completely formed of a resiliently deformable material such as an open cell (e.g., reticulated foam), partially open cell, or closed cell polyurethane-based foam, and in certain instances the headboard 110 may be completely formed of a low-resilience polyurethane foam and/or a high density polyurethane. In certain instances, this the headboard 110 is formed of either a closed cell or open cell polyurethane (e.g., high density polyurethane) having a compression modulus ranging from 75 lbs. to 80 lbs at ambient conditions and more preferably from 77.5 lbs. to 82.5 lbs at ambient conditions. Furthermore, the headboard 110 being formed of either a closed cell or open cell polyurethane (e.g., high density polyurethane) preferably has an R-value (as a measure of hardness) ranging from 1.6 lbs. per cubic foot to 2.1 lbs. per cubic foot at ambient conditions, and more preferably from 1.7 lbs per cubic foot to 1.8 lbs per cubic foot at ambient conditions. In certain aspects, the polyurethane foam has a cell density ranging from 1.6 to 1.8 cells/cm$^3$) ($\times 10^{10}$) and more preferably from 1.65 to 1.75 cells/cm$^3$) ($\times 10^{10}$). In certain aspects, the headboard 110 is a closed cell polyurethane having the above mentioned hardness and compressibility characteristics, which allow for ease of shipping the headboards in a compressed while concurrently and advantageously providing high rigidity while the headboard is in use such that if remains durable throughout the lifespan of the product even under heavy and frequent use (e.g., daily use). Moreover, the polyurethanes disclosed herein are either castable or thermoplastic polyurethanes but are not millable polyurethanes. Both castable and thermoplastic polyurethanes have a segmented structure, where the polyurethane portions formed from diisocyanate represents the hard segments, while the polyurethane portions formed from polyether or the polyester polyols represent the soft segments. The elasticity comes from the segregation of the segments. Chain extenders are typically short-chain molecules used to increase the molecular weight and thus improve polyurethane strength. The majority of the head board 110 (or, in preferred aspects, the headboard is completely) comprised of these materials for packaging and handling purposes. For example and as specifically shown in FIGS. 9A and 9B, the headboards 110 may be compressed, vacuumed sealed (e.g., hermetically sealed), and packaged in a headboard packaging wrapper 300 for shipping purposes, and when assembling the bed assemblies 100 as disclosed further below, the headboard 110 may be removed from the packaging 300 and allowed to expand achieving a fully decompressed state (i.e., shown as headboard 110 in FIG. 3A).

Figure 3A:
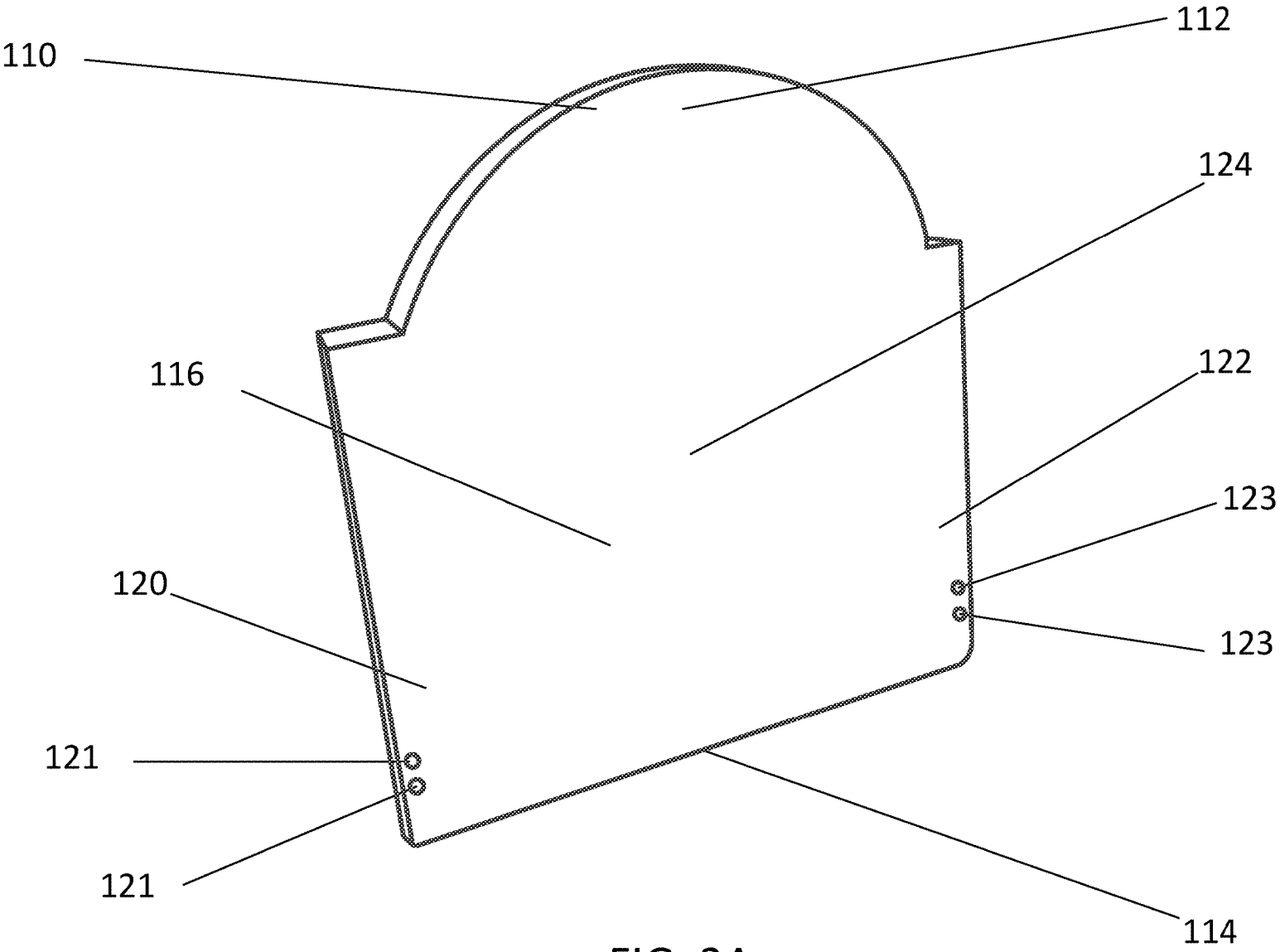
FIGS. 3A, 3B, 3C, 3D, 3E, 3F, 3G, and 3H sequentially depict positioning and securing the slip cover on the foam based headboard.
Figure 3B:
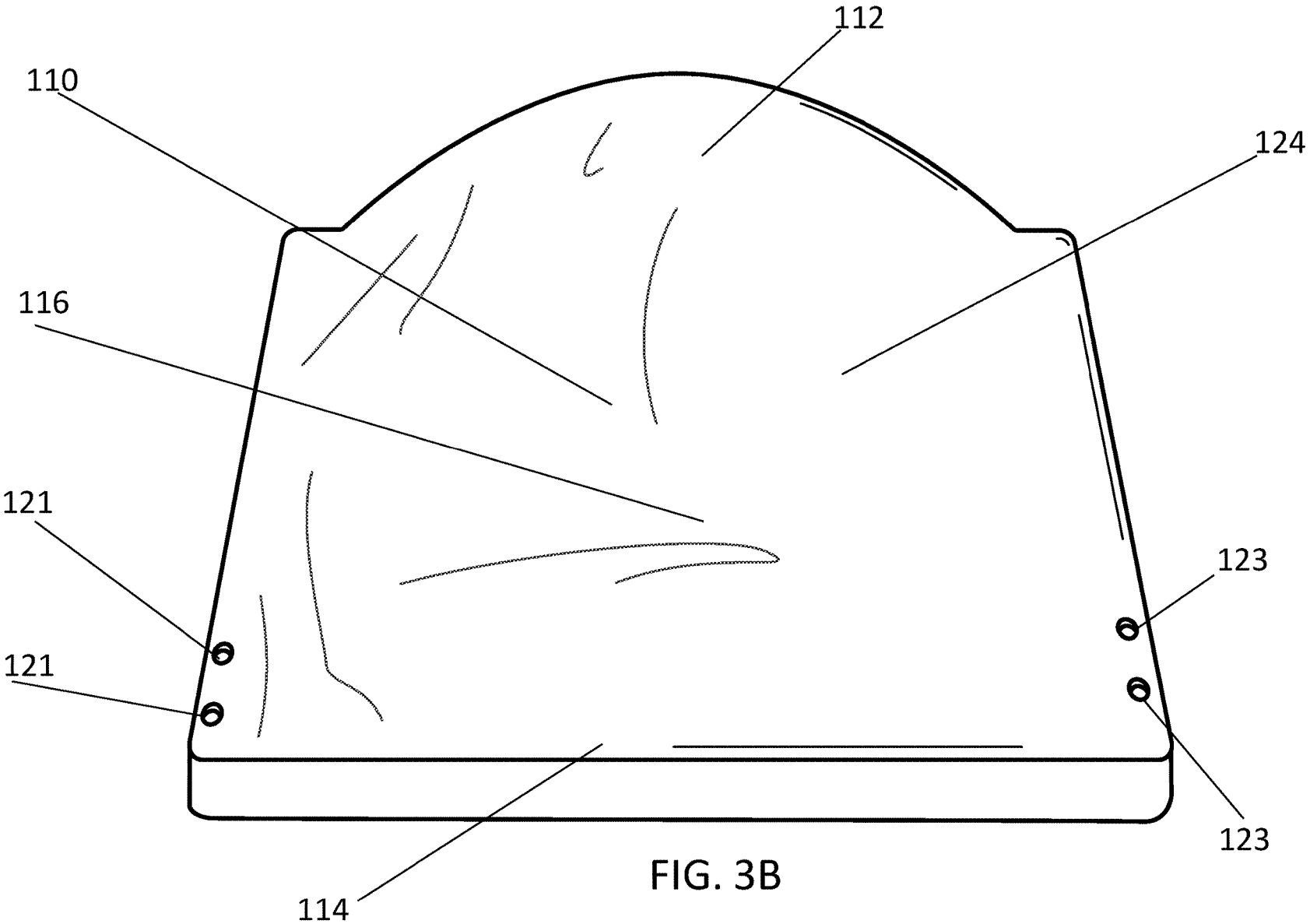
Figure 3C:
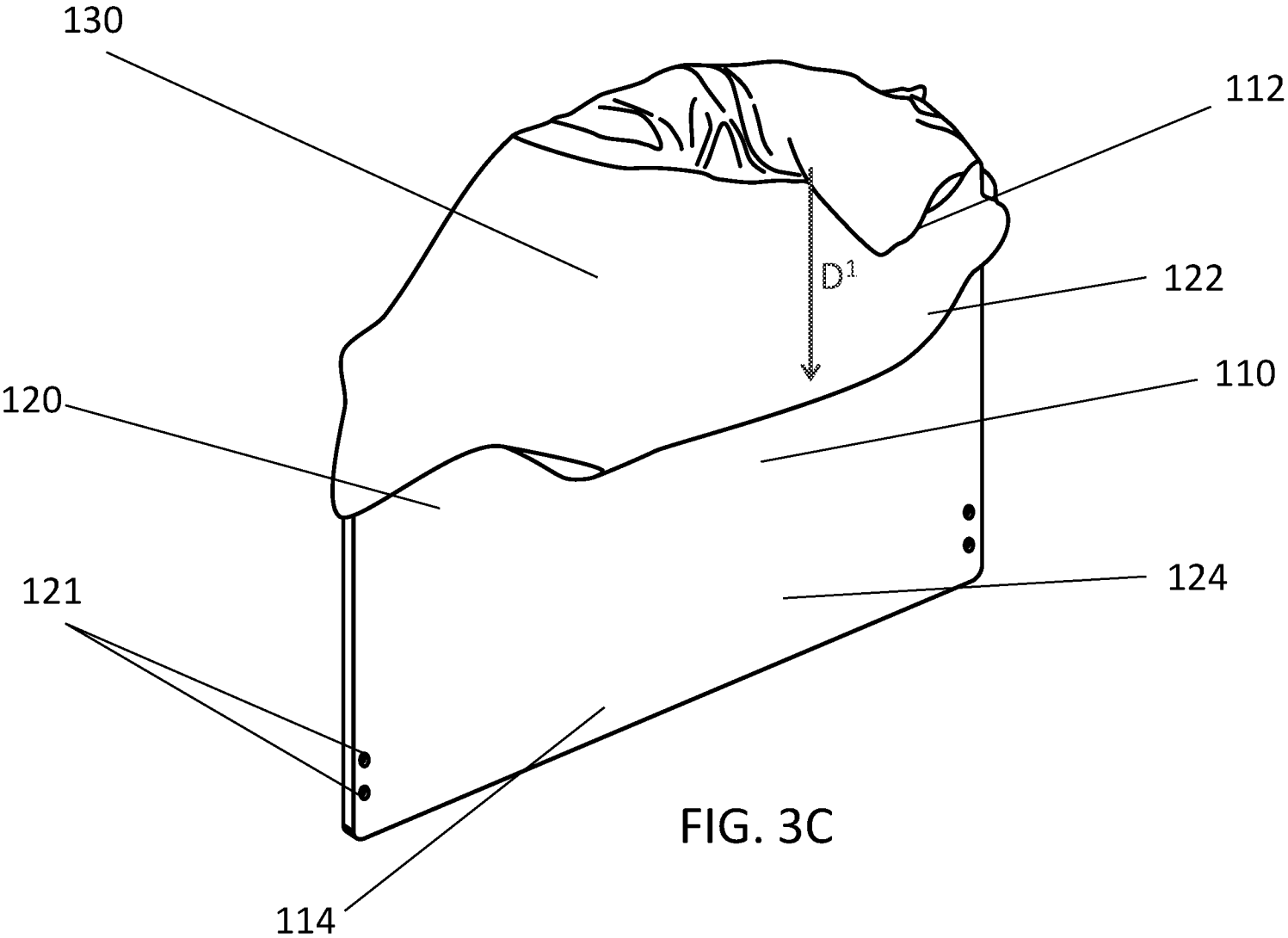

As shown in FIGS. 3A and 3B, the headboard 110 includes a top/upper end 112, a bottom/lower end 114, a front 116, a back 118, a left side 120, optional through holes (on left side) 121 for attachment to the bed frame assembly if desired, a right side 122, and optional through holes (on right Side) 123 for attachment to the bed frame assembly if desired. Also, the headboard 110 further includes an outer covering 124 (protective outer covering) positioned over and permanently attached to the foam based material comprising the headboard.

Figure 3D:
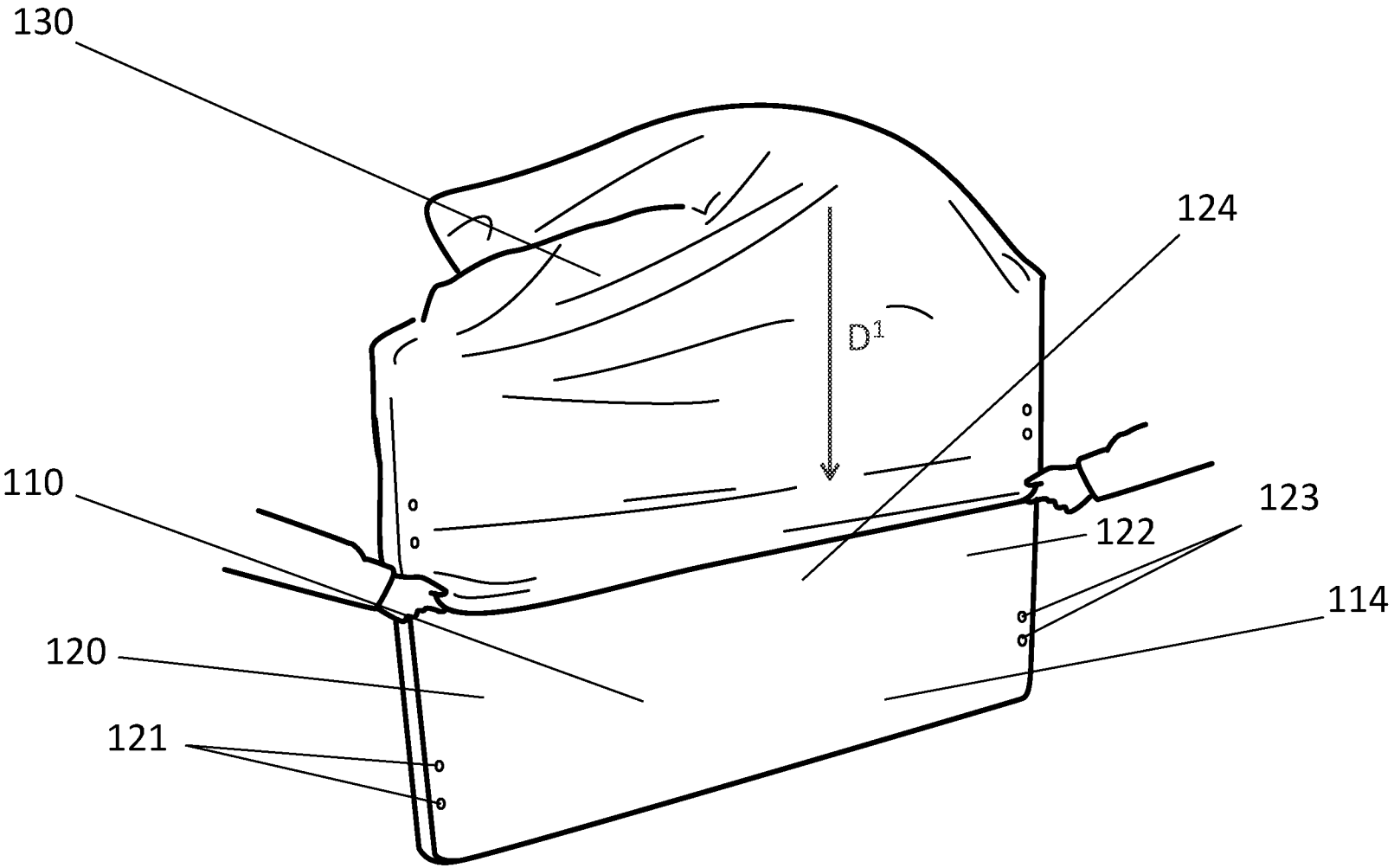
Figure 3E:
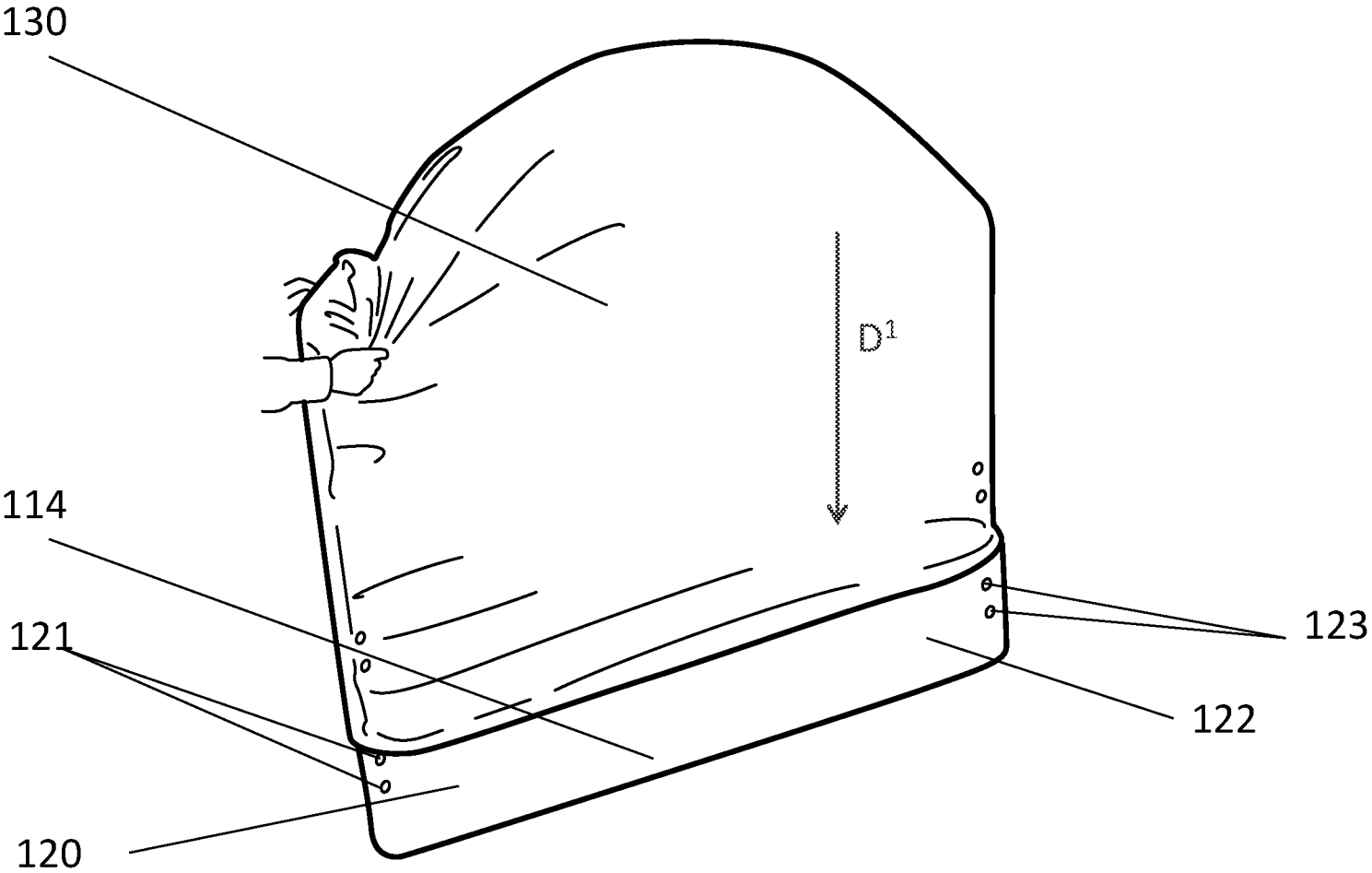
Figure 3F:
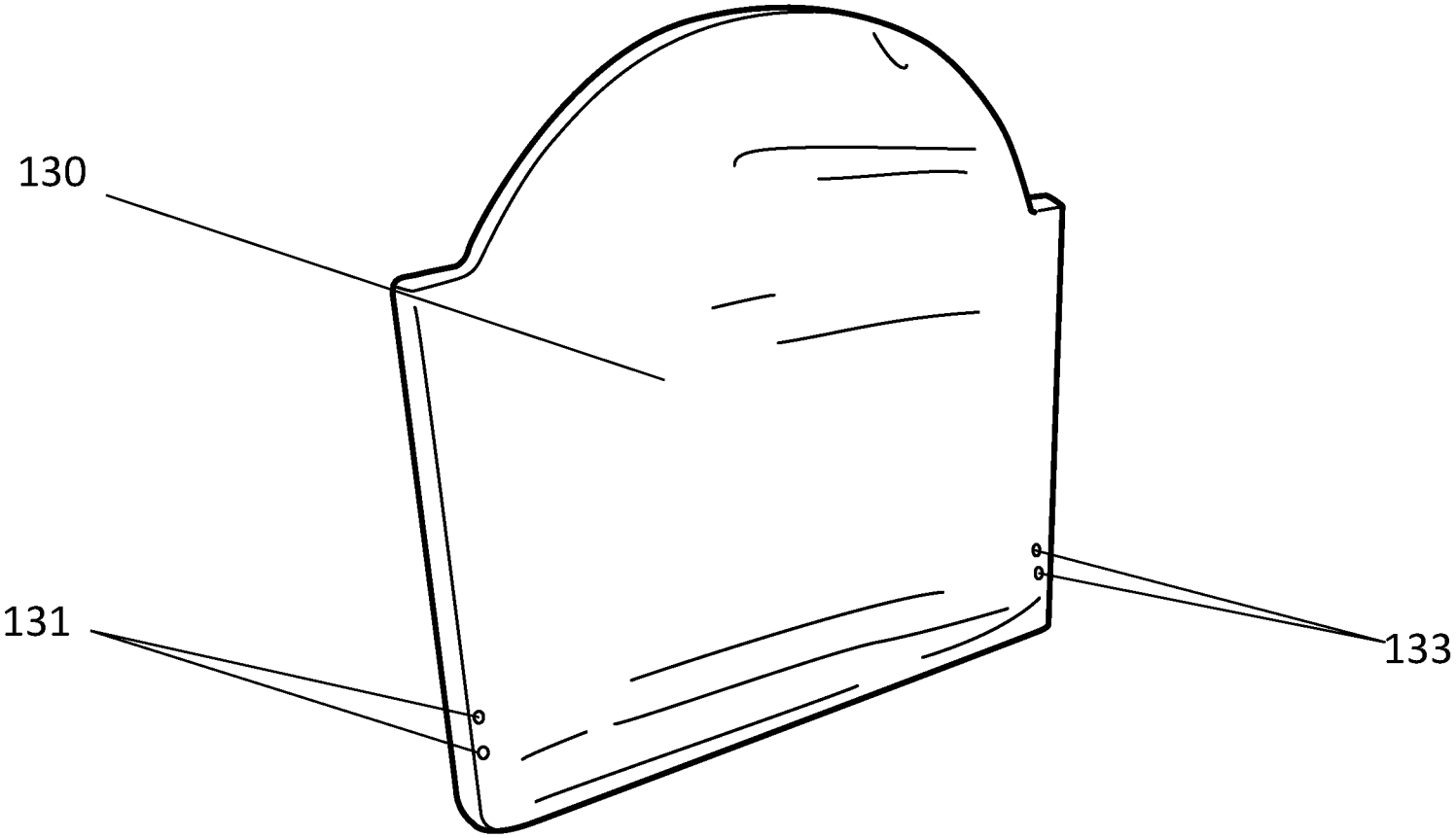
Figure 3G:
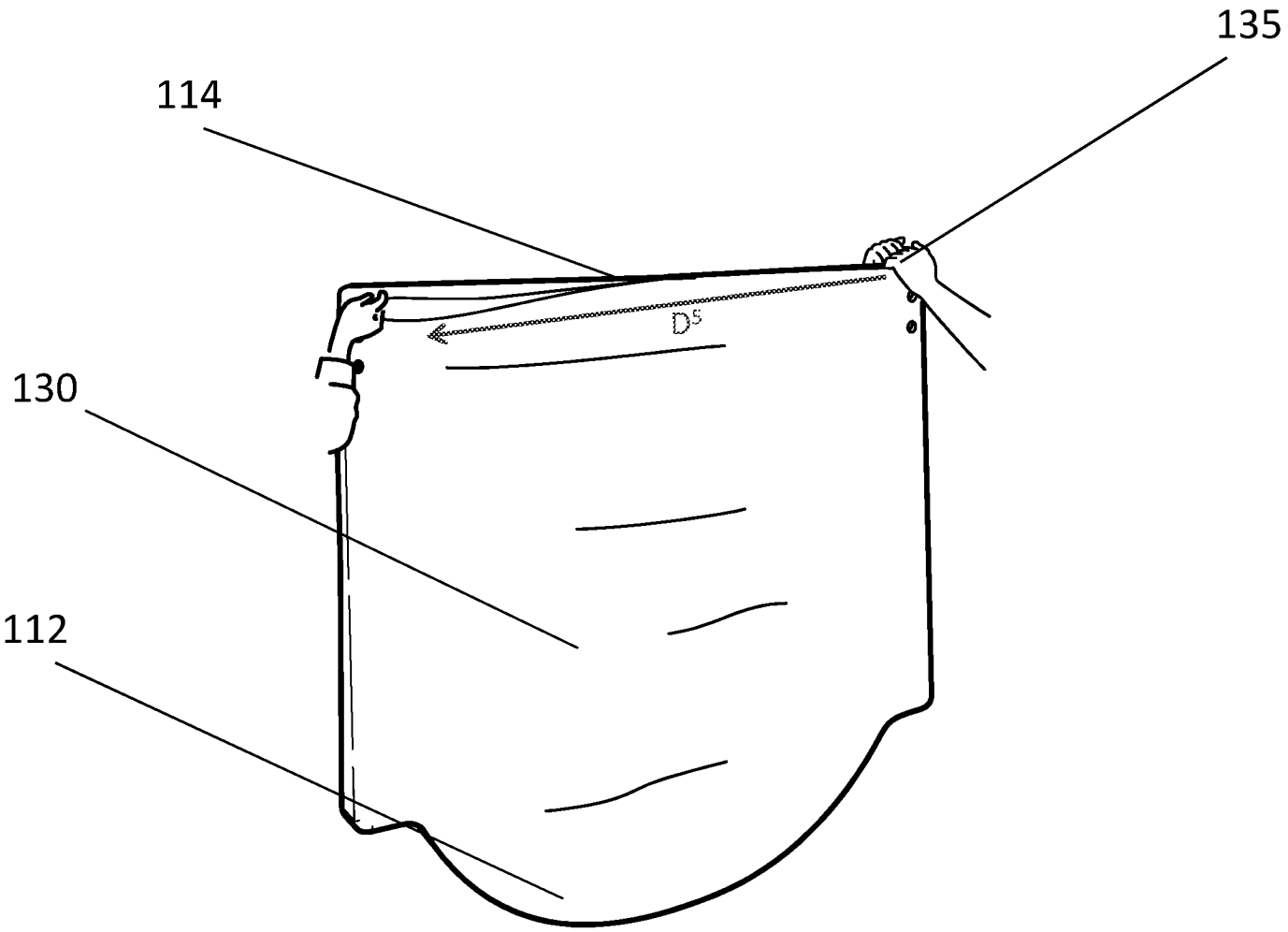
Figure 3H:
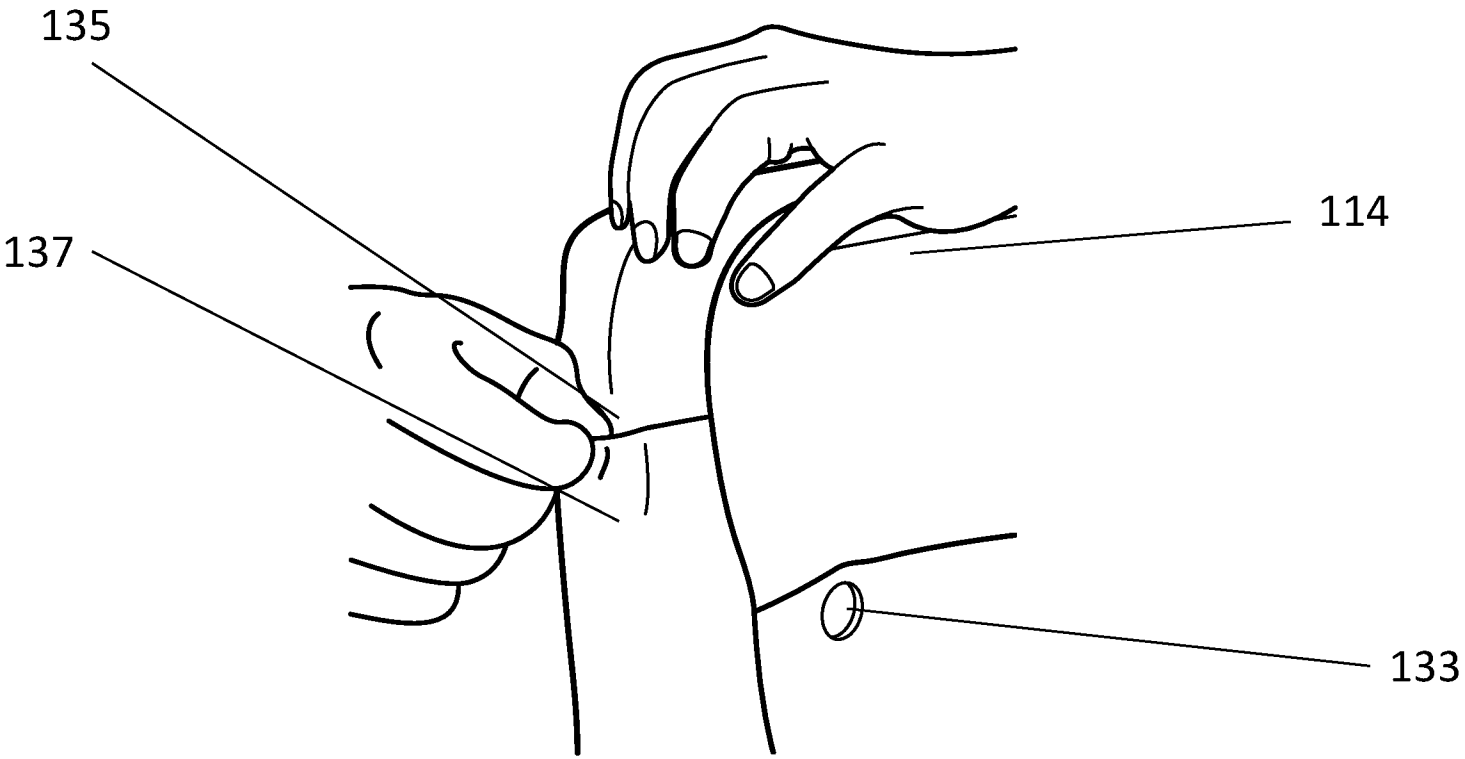

As alluded to above, the bed assemblies 100 disclosed herein include both the foam based headboard 110 and one or more slip covers 130 configured for positioning on the headboard. FIGS. 3C-3H specifically depict the slip cover 130 being positioned on and secured to the foam based headboard 110. For example, FIG. 3C specifically shows the slip cover 130 initially positioned over the top/upper end 112 of the headboard 110 in anticipation of advancing the slip cover in direction ($D^1$) towards the bottom/lower end 114 of the headboard and securing the slip cover thereto. FIG. 3D depicts the slip cover 130 advanced approximately mid-way along the length of the headboard in a downward direction ($D^1$) towards the bottom/lower end 114 of the headboard. FIG. 3D depicts the slip cover 130 advanced the majority of the length of the headboard in a downward direction ($D^1$) towards the bottom/lower end 114 of the headboard, and FIG. 3F depicts the slip cover 130 advanced substantially completely the entire length of the headboard along the bottom/lower end 114 of the headboard with slip cover through holes 131, 133 being substantially aligned with headboard through holes 121, 123, with these through holes being configured for attachment to the bed frame assembly if desired. As shown in FIG. 3G (and after advancing the slip cover 130 substantially the entire length of the headboard), the slip cover 130 is securely pulled over and attached to the bottom/lower end 114 of the head board by engaging/fastening a fastening mechanism 135 (e.g., a zipper, hook and loop fasteners, and/or buttons) positioned on the slip cover 130. FIG. 3G specifically depicts the fastening mechanism being advanced in direction $D^5$ along the bottom peripheral edge of the bottom/lower end 114 of the head board, and FIG. 3H further depicts the fastening mechanism 135 (e.g., zipper) being placed within and concealed by pocket 137. In certain aspects, the slip cover 130 may be removed by reversing the order of steps discussed immediately above, and various different slip covers having different indicia, printing, fabric(s), and/or textures may be interchangeably positioned on and/or removed as discussed immediately above. The interchangeability of the disclosed slip covers advantageously allows a user to change the headboard's aesthetic appearance as desired and/or as needed due to wear and tear. After fastening the slip cover 130 on the headboard, the headboard may be propped/rested on a wall surface ("free floating") and positioned adjacent to an assembled bed frame assembly, or alternatively, may be secured to the assembled bed frame assembly via fasteners advanced through the through holes 121, 123, which are configured to fasten the headboard to the bed frame assembly.

Figure 4:
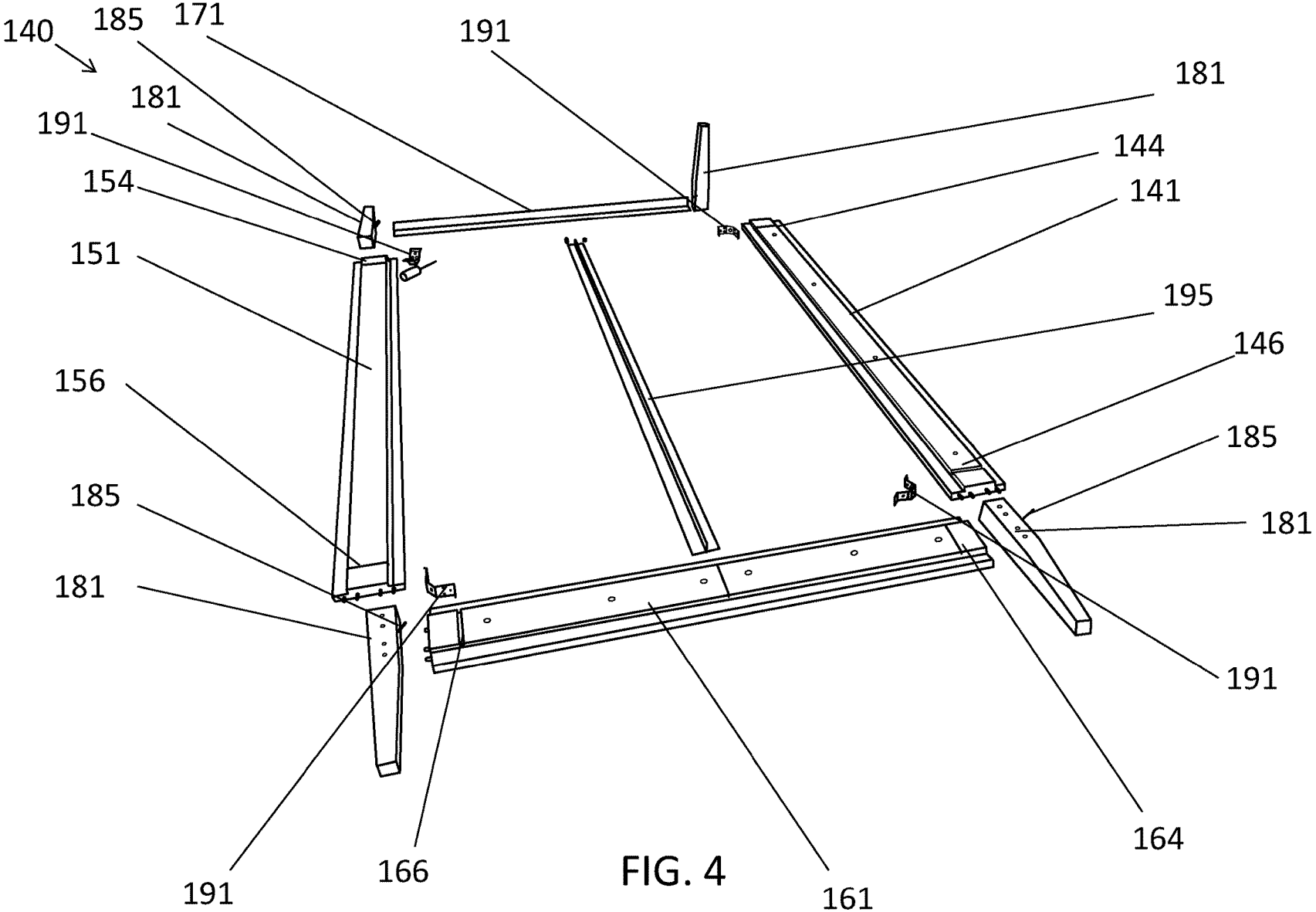
FIG. 4 depicts the disassembled bed frame assembly.
Figure 8:
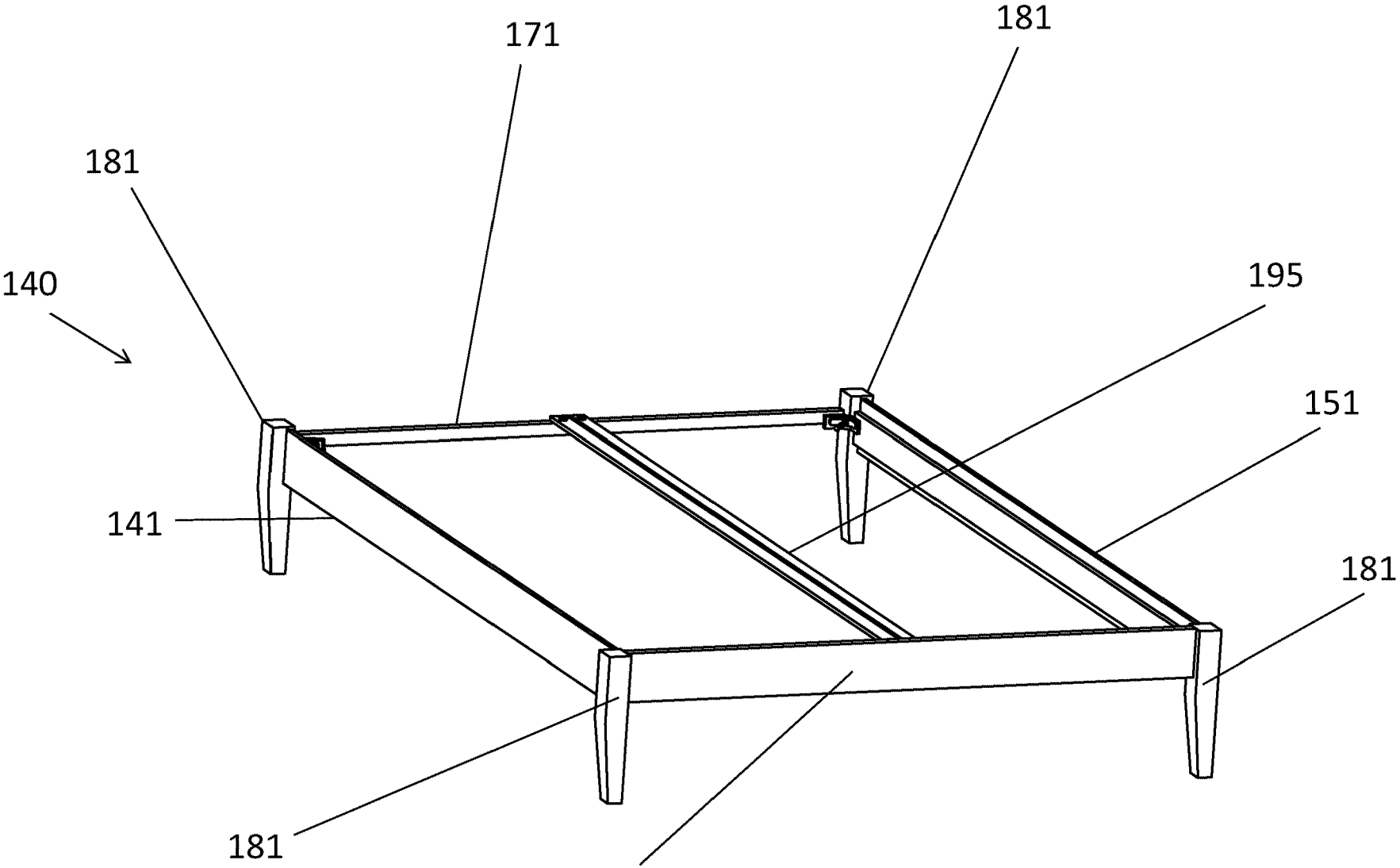
FIG. 8 depicts a fully assembled bed frame assembly.

FIG. 4 depicts the disassembled bed frame assembly 140, and FIG. 8 depicts the completely assembled bed frame assembly 140. In view of FIGS. 4 and 8 and as further previously discussed, bed frame assembly 140 comprises (i) a plurality of legs 181, each leg having a first side and second side that are each configured to securely attach to separate side rails and each leg having a securing member 185 positioned on a corner of the leg between the first side and second side of the leg that extends away from the leg towards the interior of the bed frame assembly when assembled; (ii) a plurality of side rails (left side rail 141, right side rail 151, foot side rail 161, head side rail 171) that are configured to be positioned and securely fastened between two separate legs of the plurality of legs; (iii) a plurality of securing brackets, each bracket 191 configured to be positioned on the securing member 185 of each leg, to concurrently grip two separate side rails, and to securely fasten the separate side rails to the leg by biasing the securing bracket in a direction towards the exterior of the bed frame assembly when assembled; and (iv) a support beam 195 configured to be completely positioned within the interior of the bed frame assembly between two separate side rails when the bed frame assembly is assembled to provide support and rigidity to the bed frame assembly and to further support a mattress when positioned on the assembled bed frame assembly.

Figure 5A:
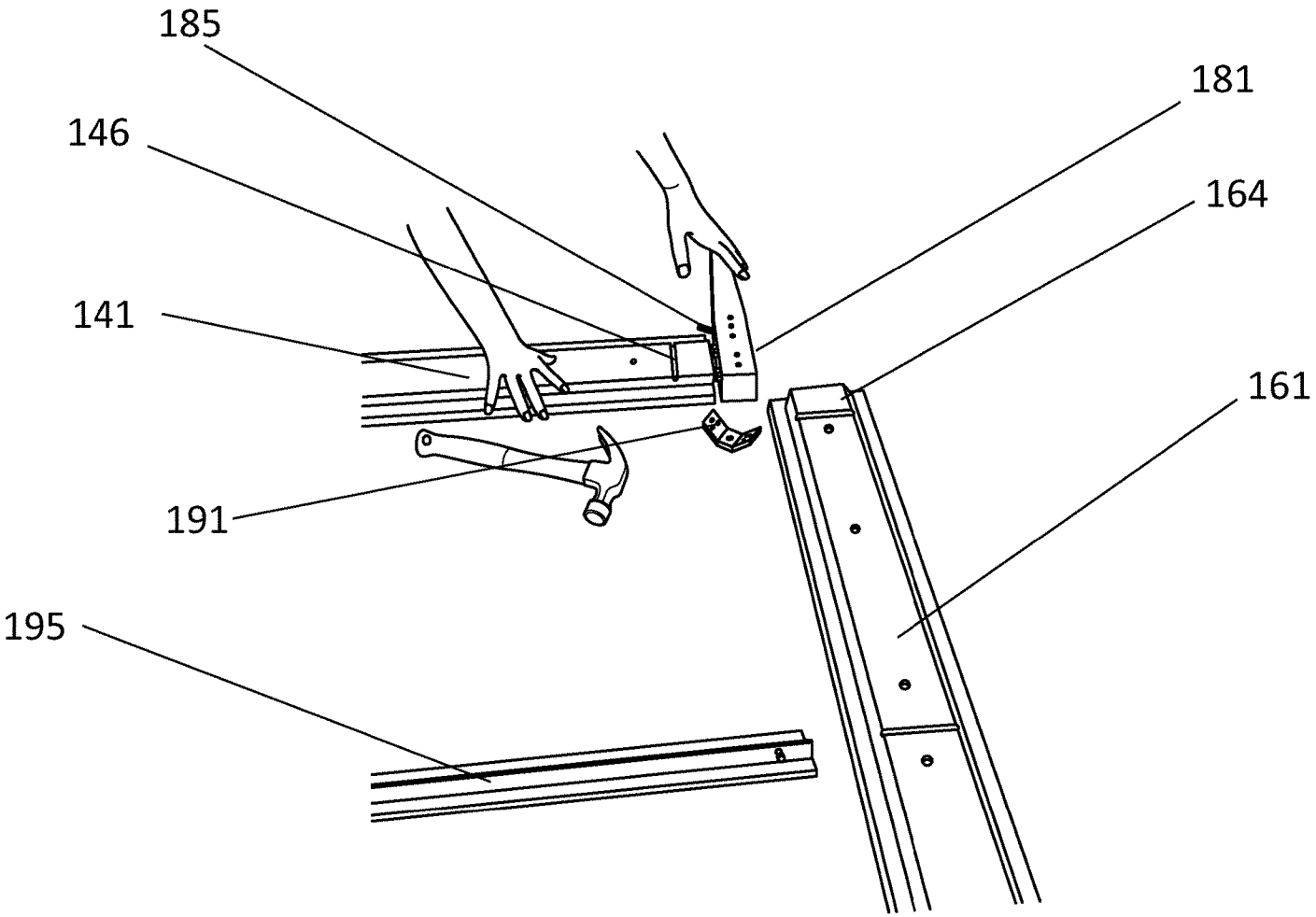
FIGS. 5A, 5B, 5C, and 5D sequentially depict assembling portions of the bed frame assembly together.
Figure 5B:
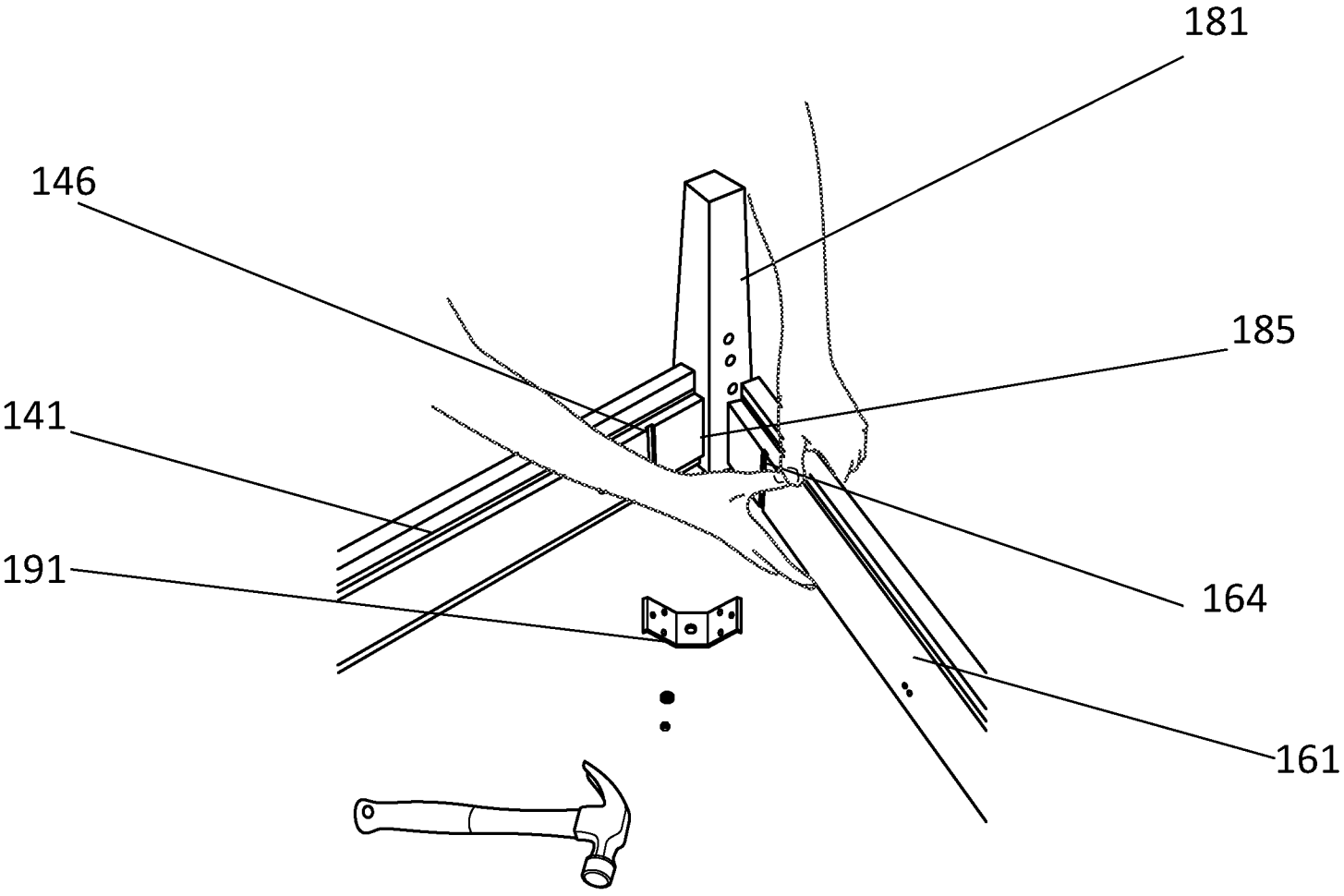
Figure 5C:
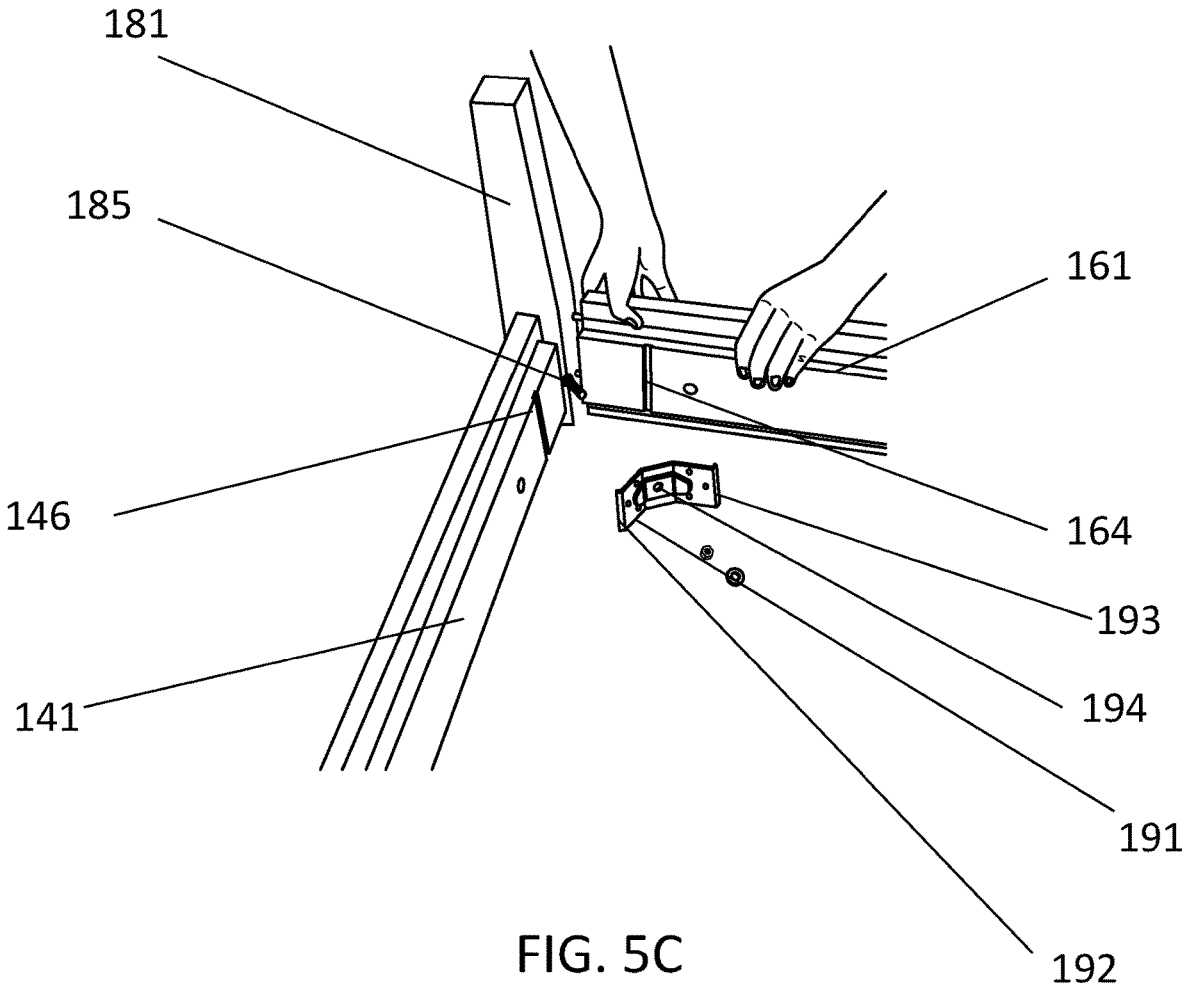
Figure 5D:
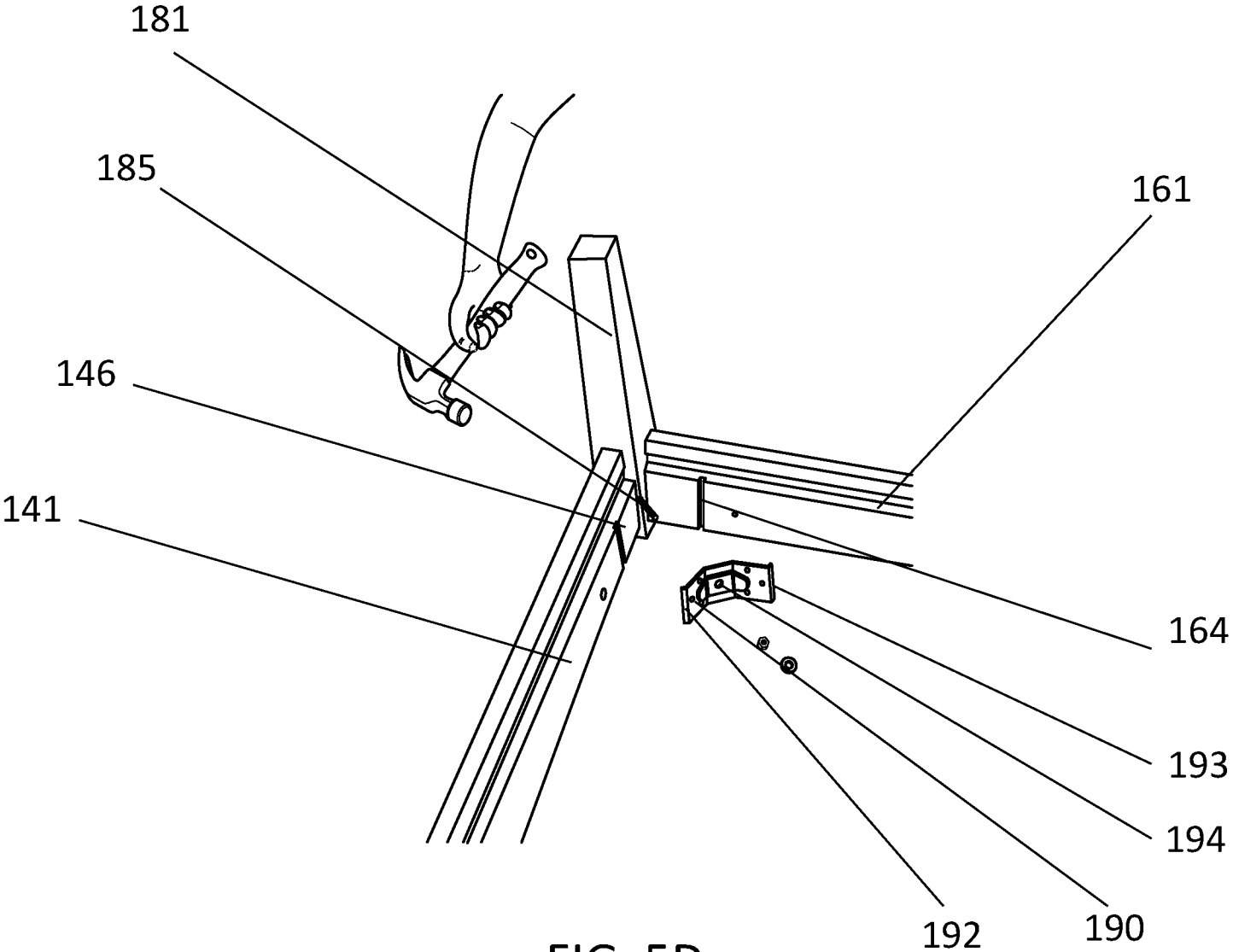

FIGS. 5A-5C sequentially depict attaching a leg 181 to at least the foot side rail 161 and to either the right side rail 151 or left side rail 141. It should be noted that when assembled within the bed frame assembly 140, the right 151 and left 141 side rails are mirror images of one another and substantially attach to the leg(s) 181 disclosed herein in an identical manner. FIG. 5A specifically depicts the left side rail 141 being initially aligned and affixed to one of a first side (or second side) of the leg, and FIG. 5B shows the leg and the other side rail being aligned and affixed to the other side of the leg 181. In certain aspects, each end of the side rails (141, 151, 161, 171) include one or more recesses (e.g., holes) formed on the end(s) of each side rail. These recesses (holes) are configured to align with corresponding recesses (holes) formed in the first 182 and second 183 sides of each leg 181. Either the recesses (holes) formed in the ends of the side rails (141, 151, 161, 171) or the recesses (holes) formed in each of the first 182 and second 183 sides of each leg 181 are fitted (e.g., friction fitted therein) with solid, rigid elongate structures (e.g., dowels/dowel rods) that are configured to fit into the corresponding recesses (holes) formed on the leg (and/or side rails) such the ends of the side rails may be securely advanced and fixedly positioned flush to the first 182 and/or second 183 sides of each leg. This process is substantially shown in FIGS. 5B and 5C.

As shown in, for example, FIGS. 4-6E, each side rail (141, 151, 161, 171) has a linear slot positioned internally along a length of each side rail and laterally adjacent to each end of each side rail. For example, the left side rail 141 has a first end 142 with linear slot 144 positioned internally along the length of the left side rail and adjacent to the first end 142, and a second end 145 with a linear slot 146 positioned internal along the length of the left side rail and adjacent to the second end 145. The right side rail 151 has a first end 152 with a linear slot 154 positioned internal along the length of the left side rail and adjacent to the first end 152, and a second end 155 with a linear slot 156 positioned internally along the length of the left side rail and adjacent to the second end 155. The foot side rail 161 also has a linear slot 164 positioned internal along the length of the left side rail and adjacent to its first end 162 and a second end 165 with a linear slot 166 positioned internal along the length of the left side rail and adjacent to its second end 165. Likewise, the head side rail 171 has a first end 172 with a linear slot 174 positioned internal along the length of the left side rail and adjacent its first end 172 and a second end 175 with a linear slot 176 positioned internal along the length of the left side rail and adjacent its second end 175.

Figure 6A:
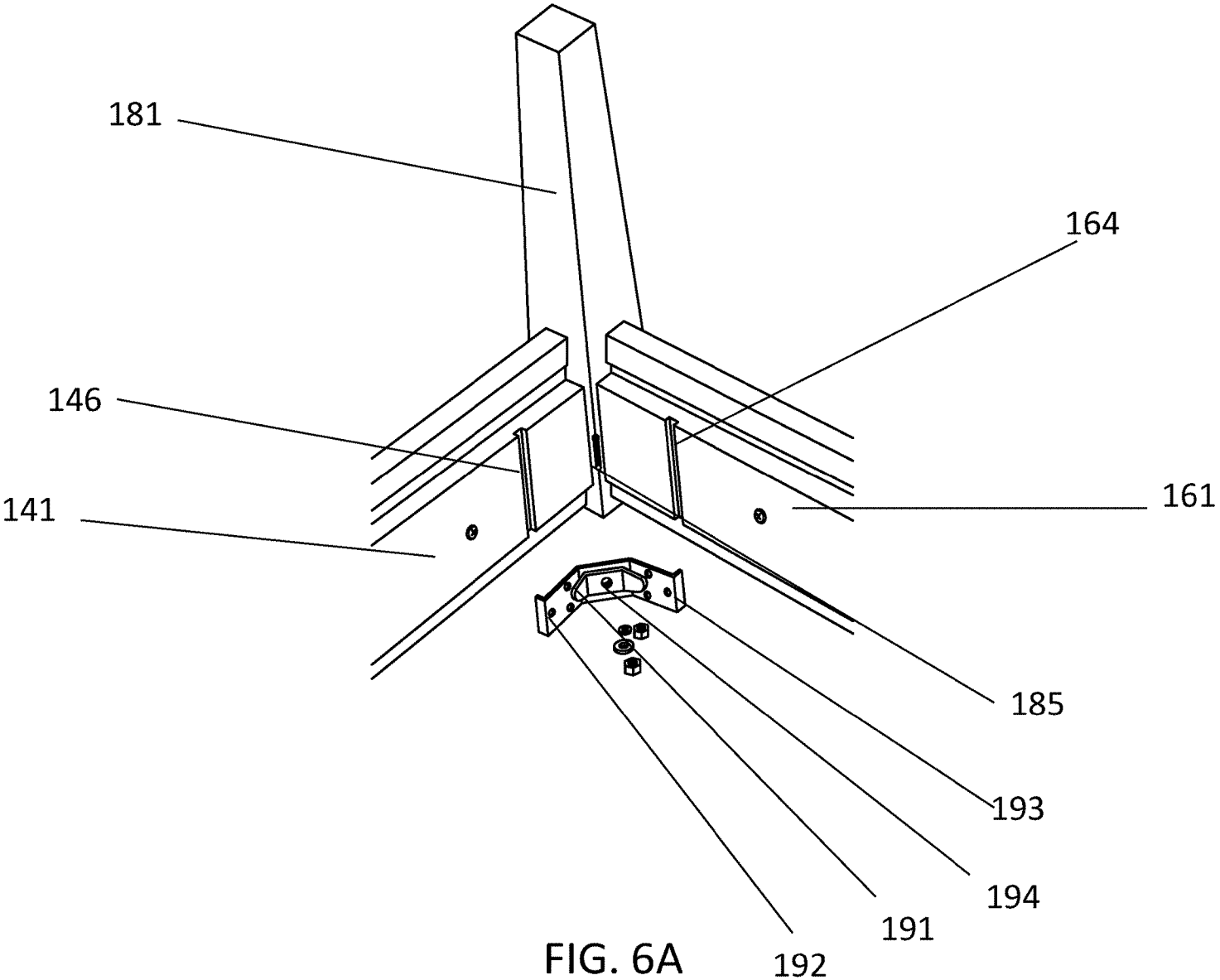
FIGS. 6A, 6B, 6C, 6D, and 6E sequentially depict positioning and securing a securing bracket to two separate bedframe assembly side rails and leg.
Figure 6B:
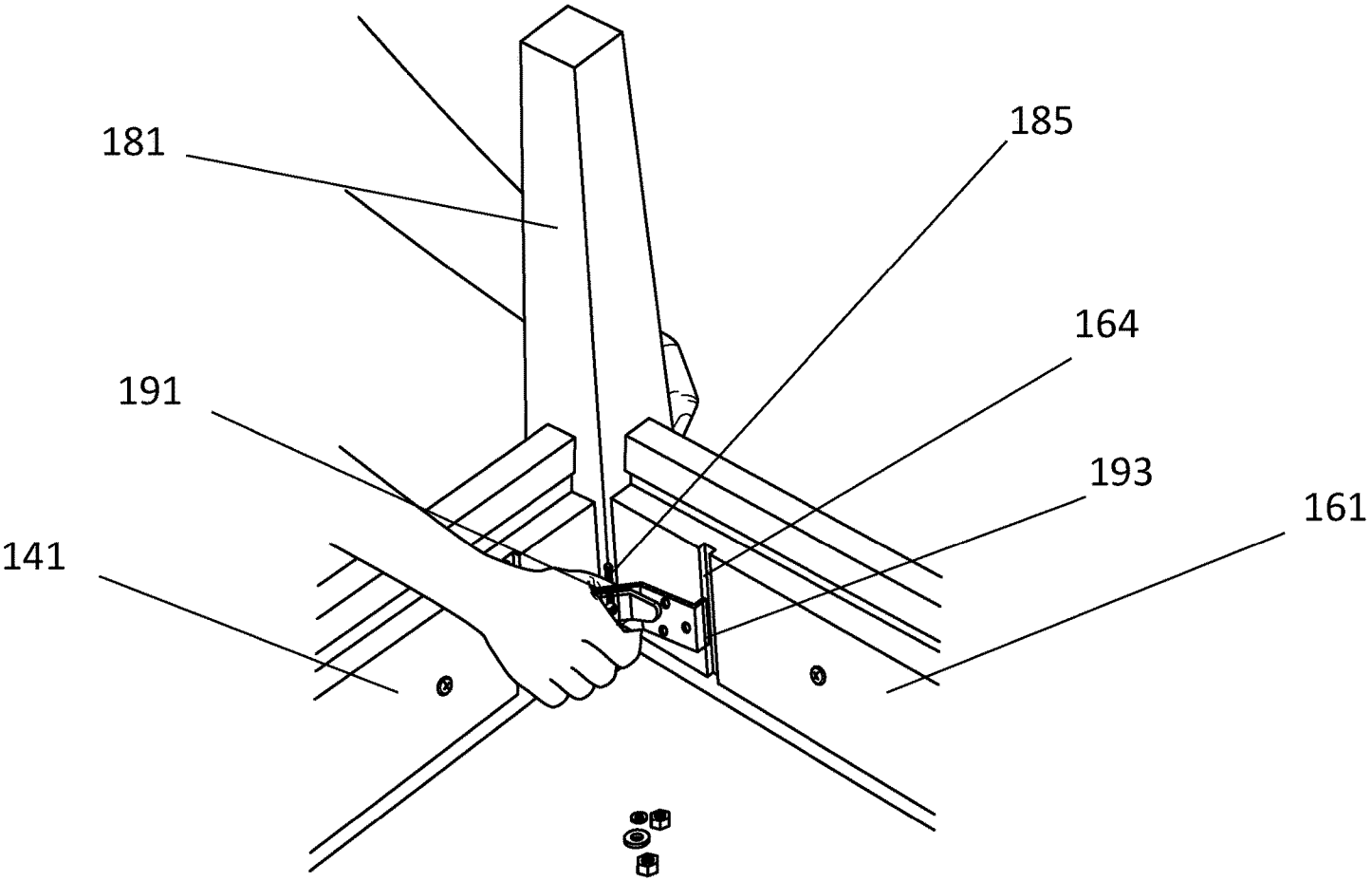
Figure 6C:
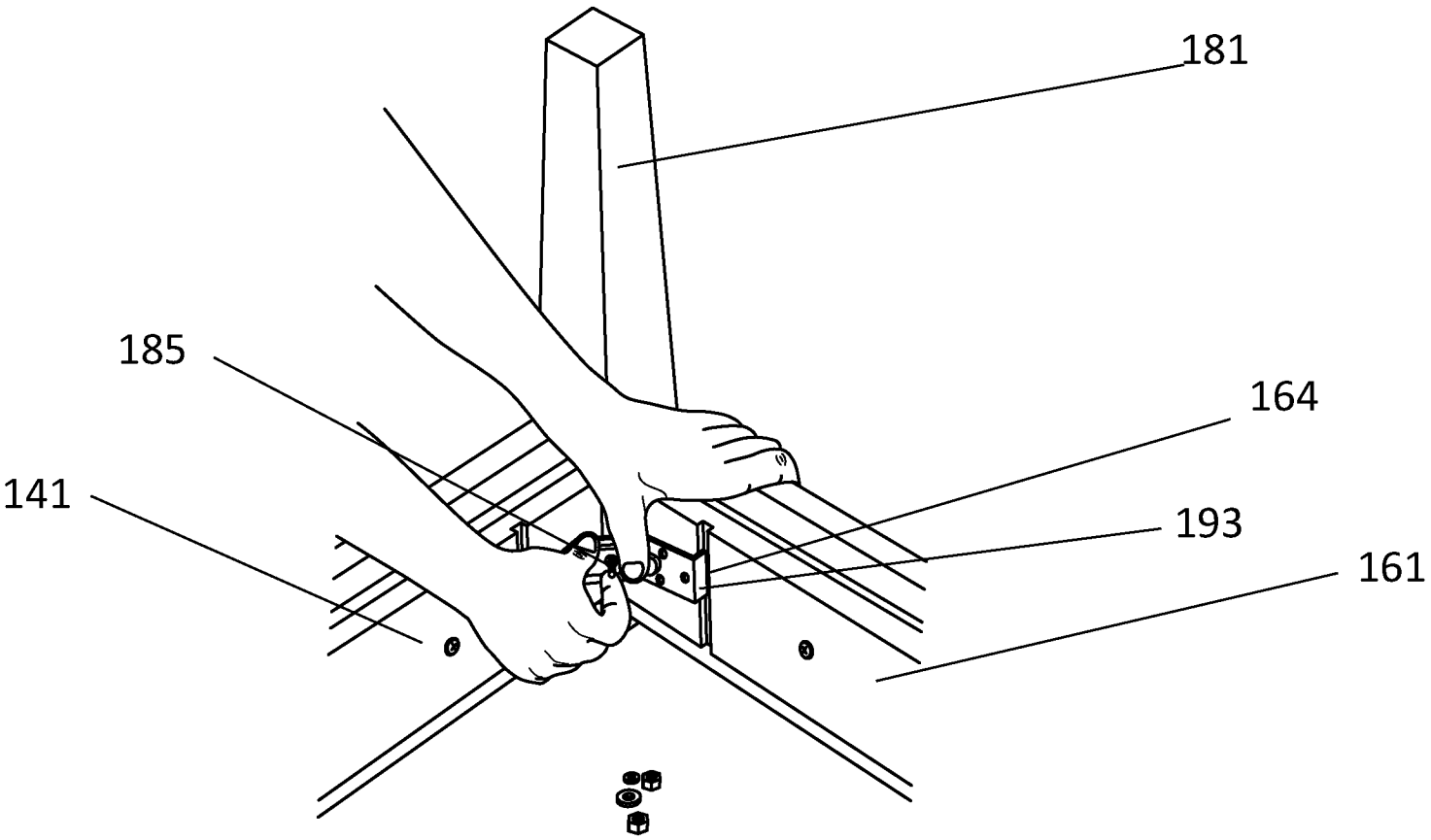
Figure 6D:
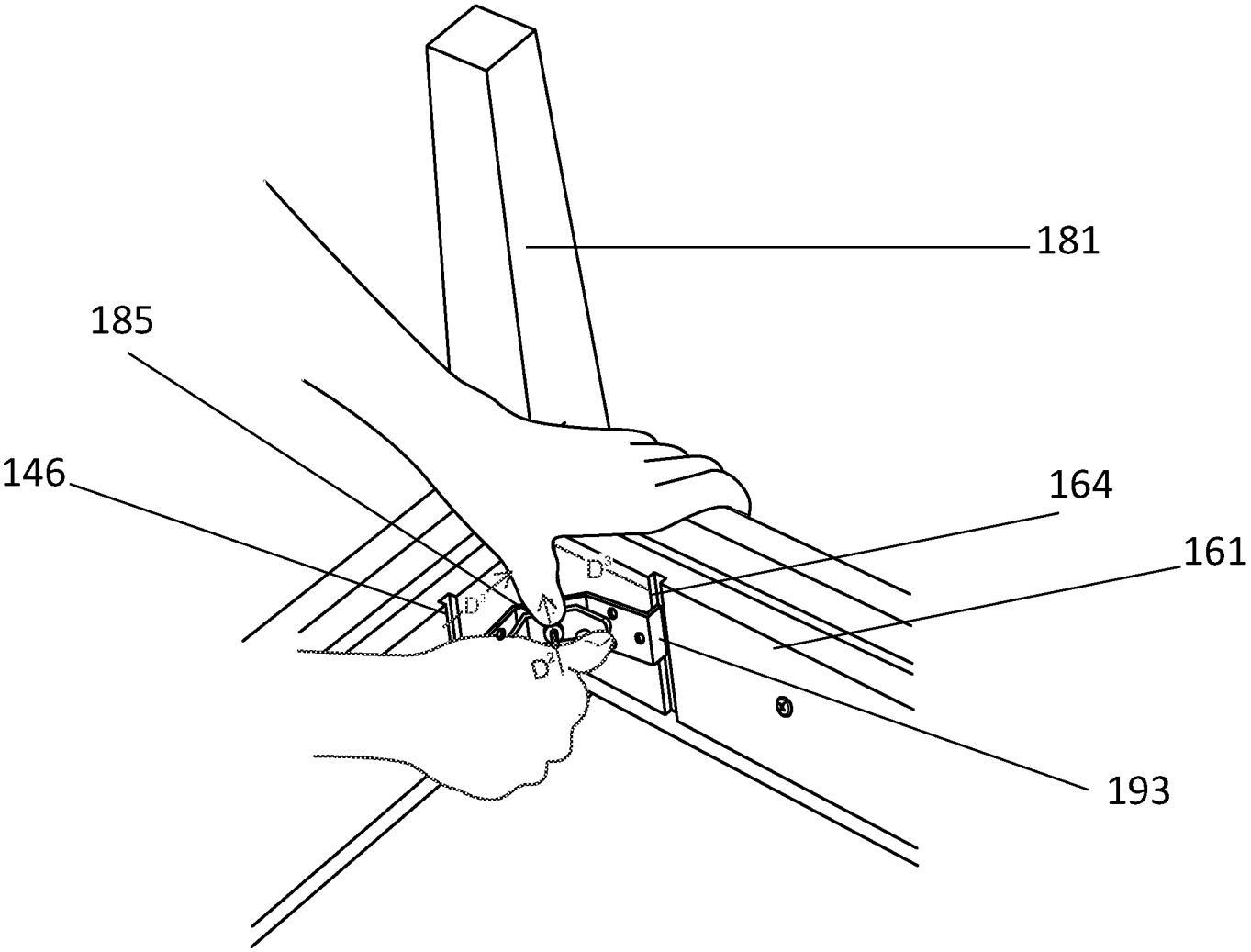
Figure 6E:
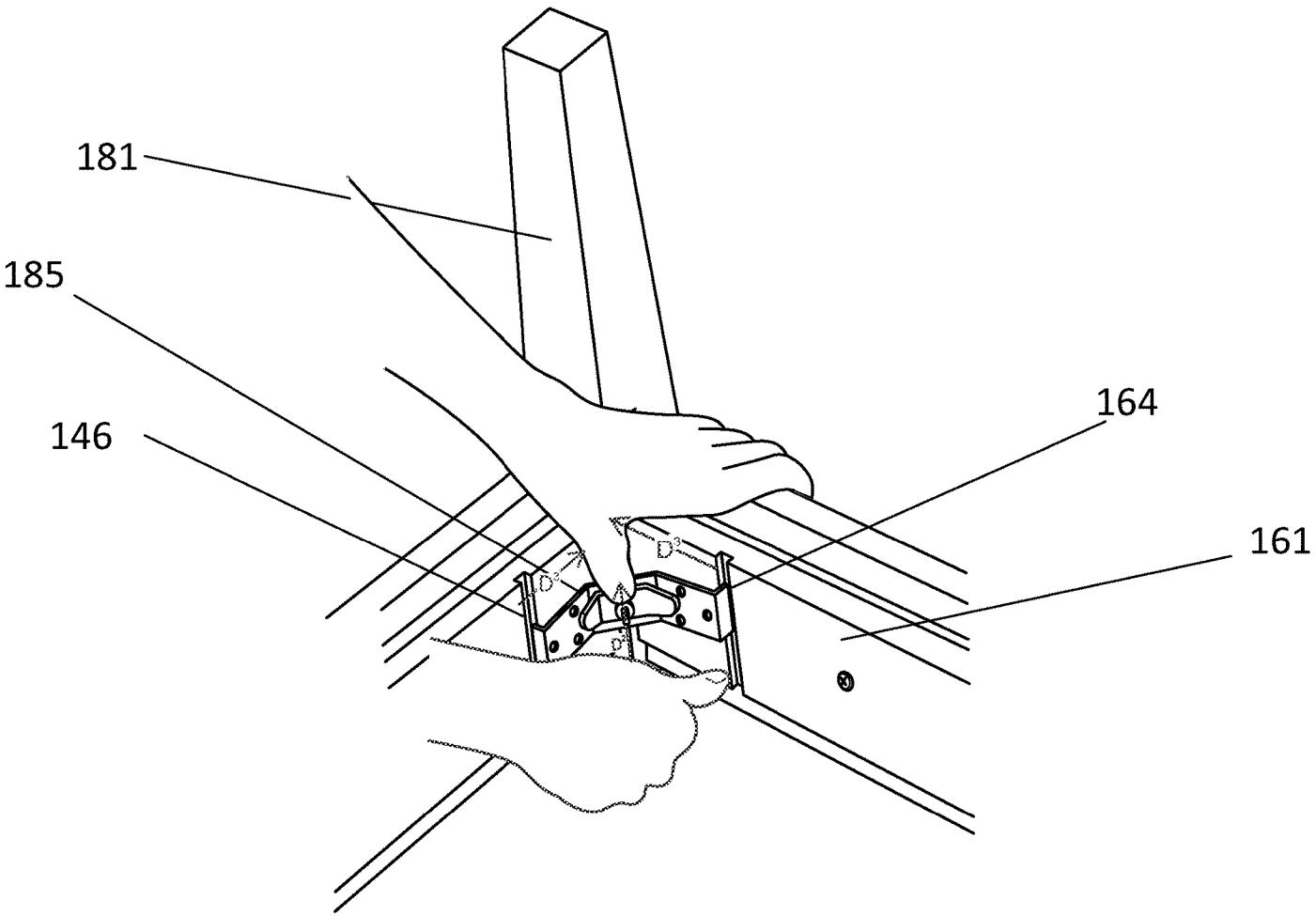

After aligning and securing/affixing two side rails to the first and second sides of the leg 181 (as discussed above), the rails and legs are further secured to one another via the securing brackets 191 disclosed herein. With specific reference to FIGS. 6A-6C, a securing bracket 191 having a first end 192, a spaced apart second end 193, and a through hole 194 positioned mid-span along a length of the securing bracket is provided. As further shown in FIGS. 6A-6C, the first and second ends 192, 193 of the each securing bracket are configured to be fitted within and grip a corresponding linear slot formed on the side rails (e.g., 146 and 164 respectively in FIGS. 6A-6C) while the through hole 194 is configured to receive the securing member 185 extending away from the leg there through. As further shown in FIGS. 6C-6E, in certain aspects, an end of the securing member 185 protrudes through the through hole 194 and preferably includes threaded portions. In order to further secure the side rails to the corresponding leg, a threaded fastener may be advanced on the securing member 185 in a direction $D^2$, as shown in FIGS. 6D and 6E, to exert force (bias/tension) in a direction towards the exterior of the bed frame assembly 140 such that each linear slot is concurrently gripped and concertedly tensioned in a direction $D^3$ towards the leg 181 by the first and second ends 192, 193 of the securing bracket thereby securely fastening the separate side rails to the leg.

Figure 7A:
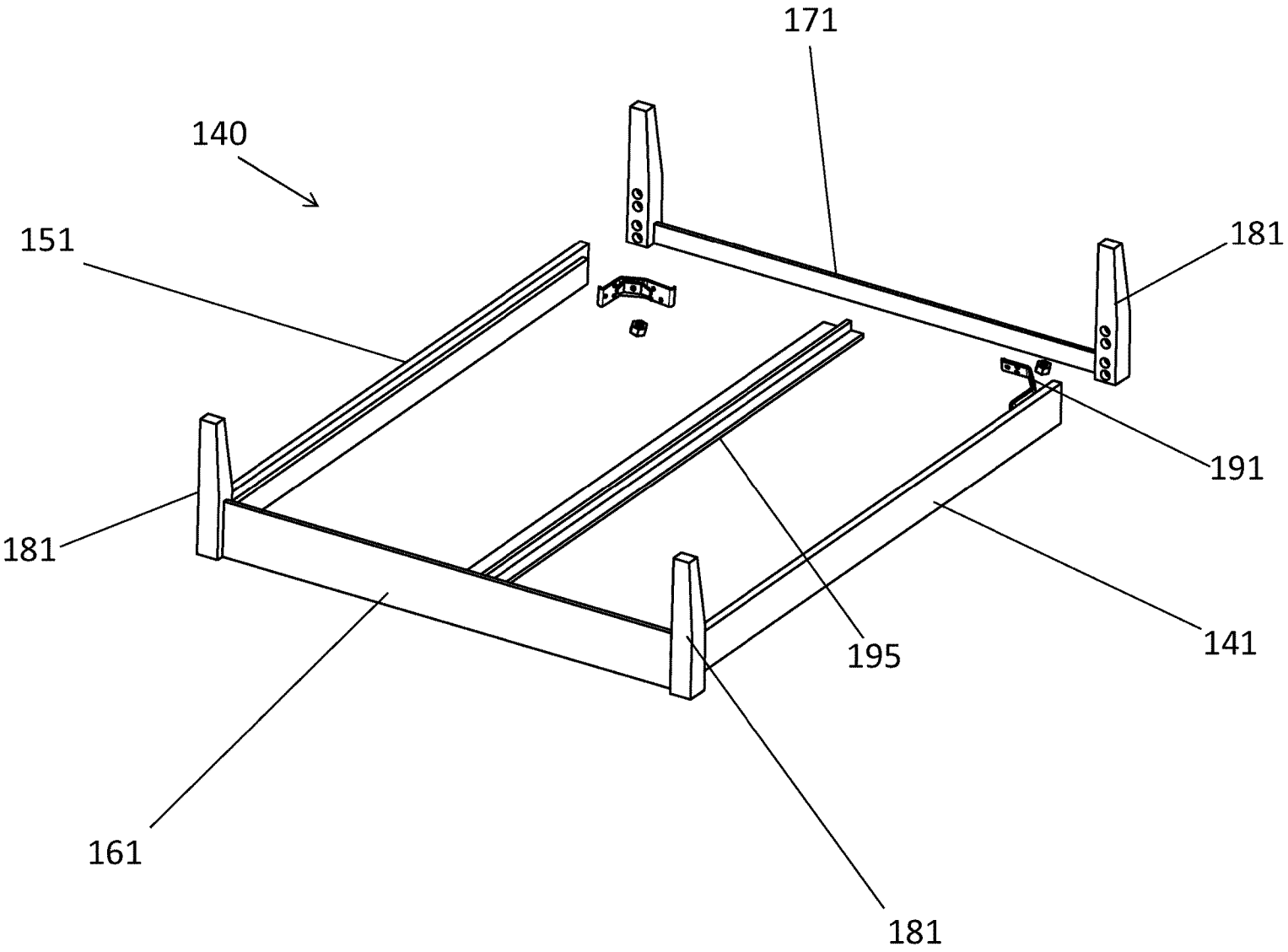
FIGS. 7A, 7B, 7C, 7D, 7E, and 7F sequentially depict securing the head side rail between two legs at the head of the bedframe assembly and subsequently positioning and securing a securing bracket to the head side rail, another side rail, and leg.
Figure 7B:
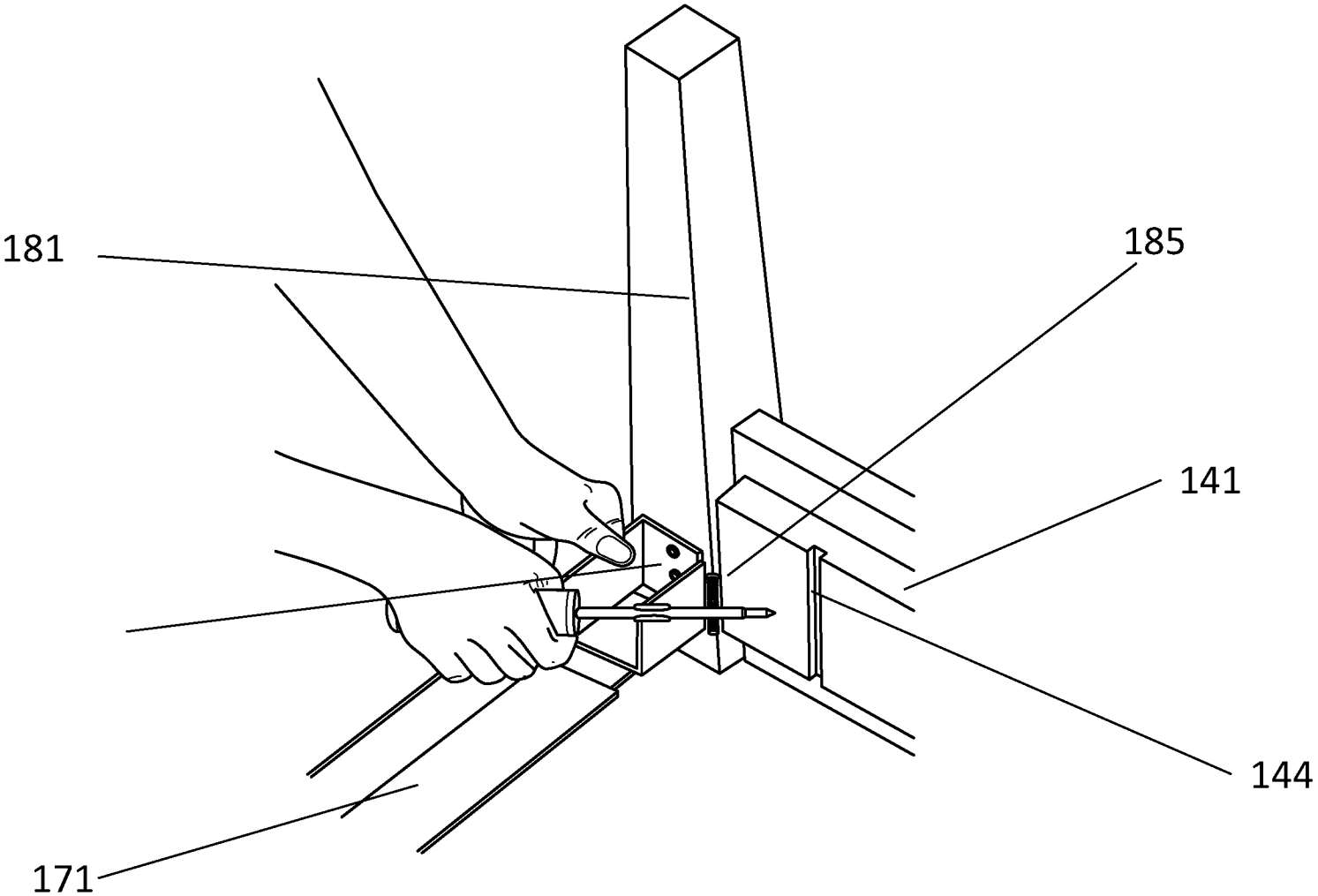
Figure 7C:
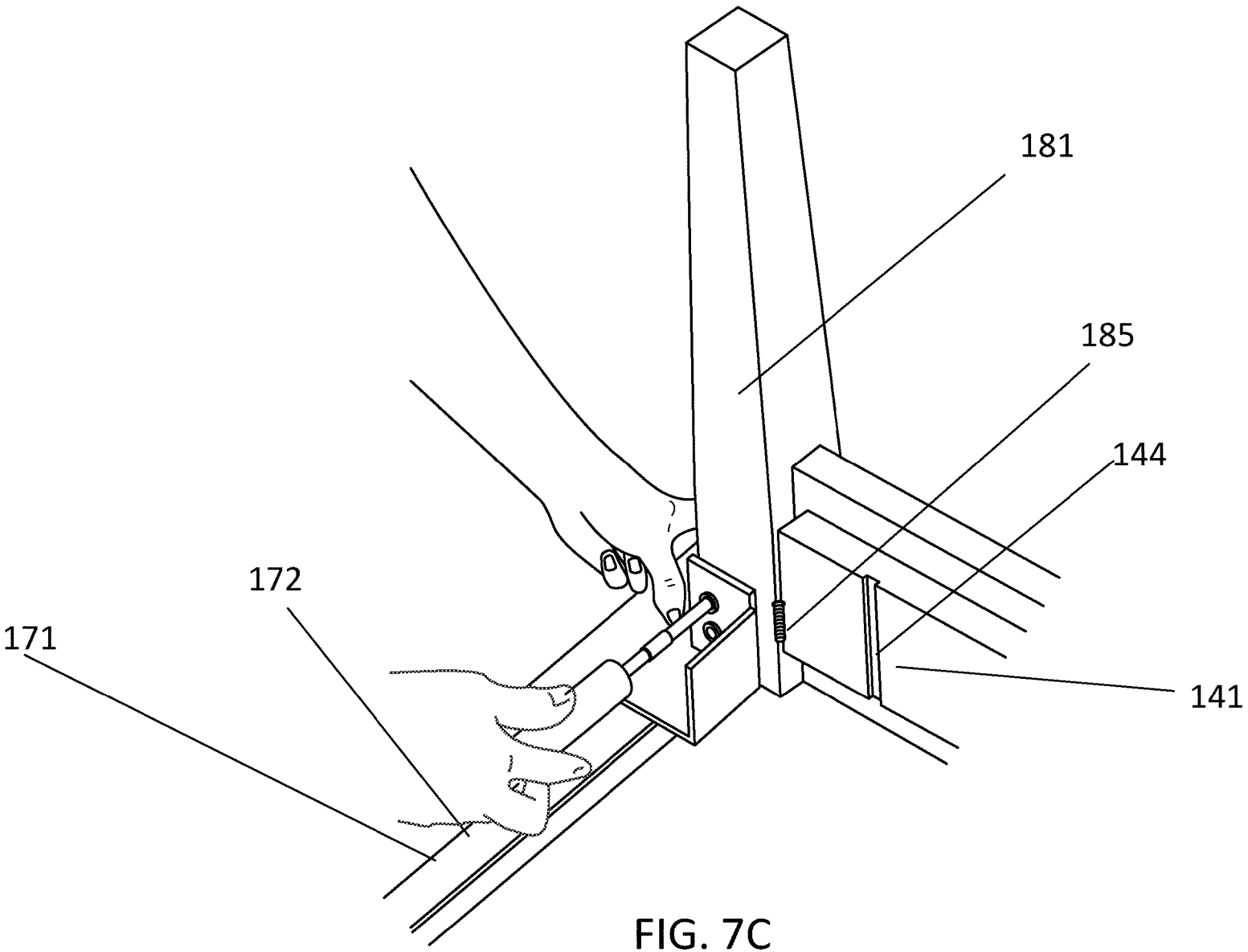
Figure 7D:
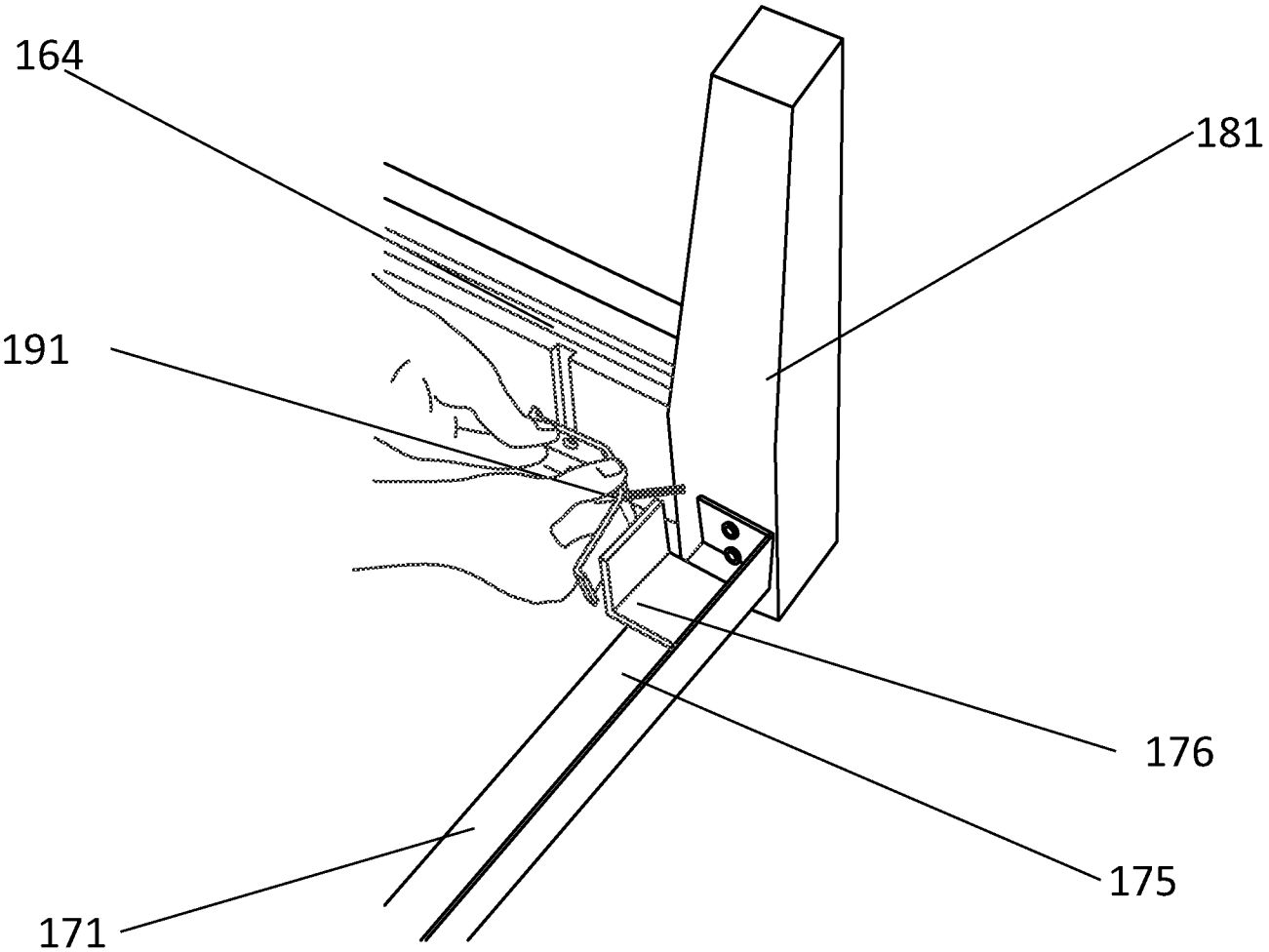
Figure 7E:
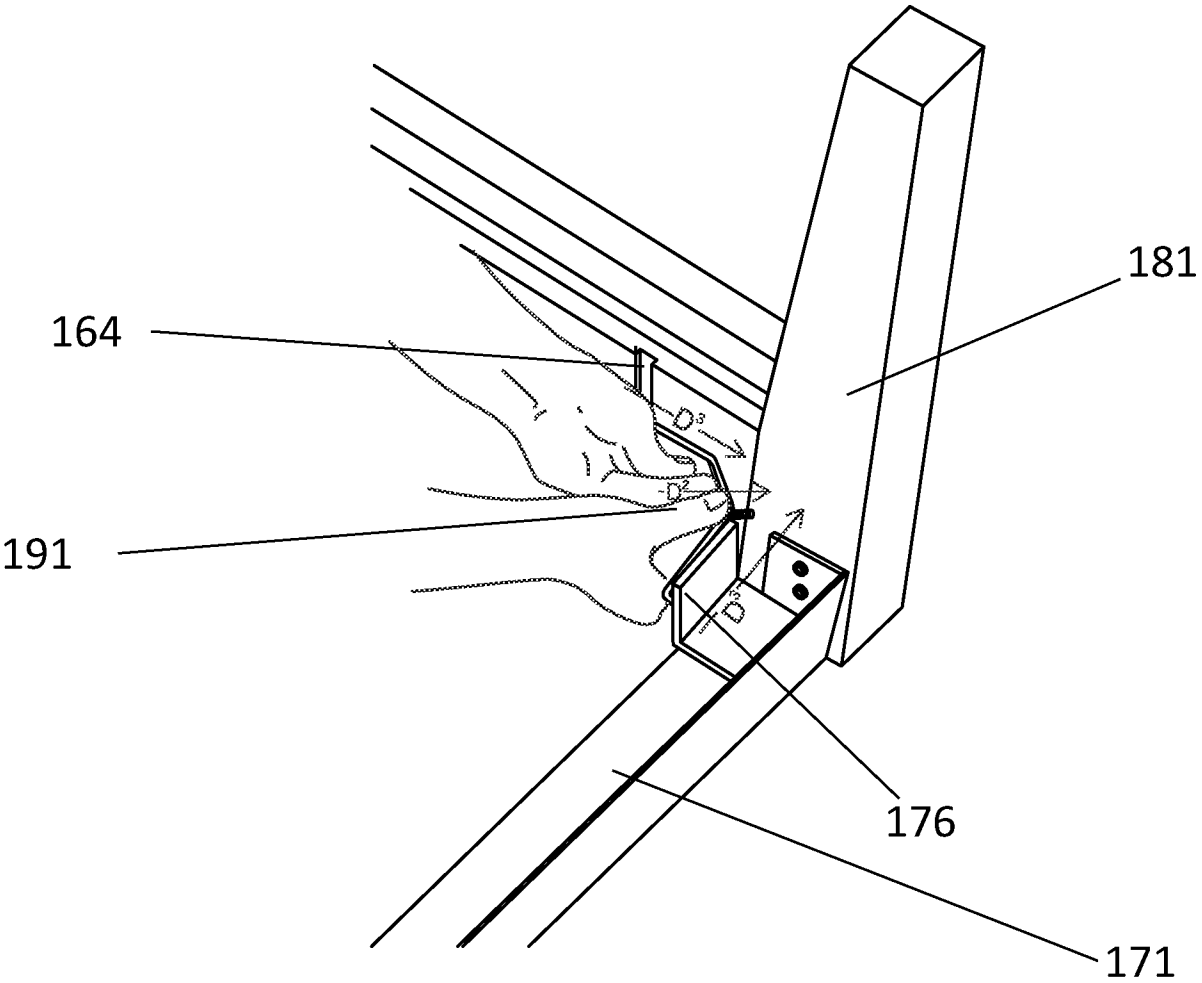
Figure 7F:
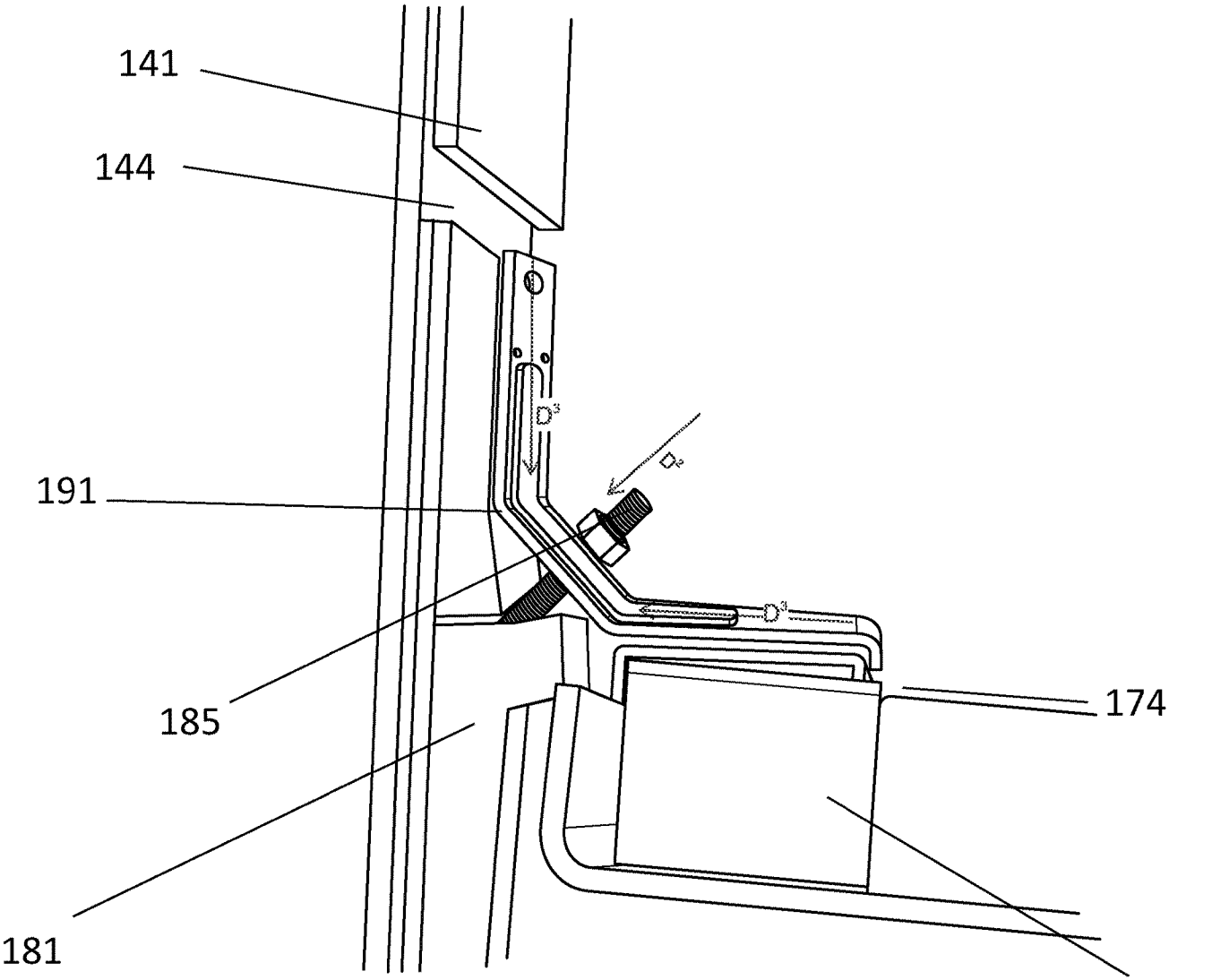

FIGS. 7A, 7B, 7C, 7D, 7E, and 7F sequentially depict securing the head side rail 171 between two legs 181 at the head of the bedframe assembly 100. As shown in FIGS. 7A-7F, in certain aspects, the head side rail is slightly different than the left, right, and foot side rails 141, 151, 161. For example, the head side rail may be a metal beam instead of being formed of wood in order to further improve rigidity and overall structural integrity of the frame. In addition and as further shown in FIGS. 7B and 7C, the head side rail 171 has two spaced apart ends that terminate with a planar shaped plate(s) having through holes extending there through. These through holes are configured to align with recesses (holes) formed on the legs 181 and are further configured to receive fasteners (e.g., screws) there through to securely fasten each end of the head side rail to a side of the adjacent leg. As further shown in FIGS. 7D and 7E (and magnified view FIG. 7F), a securing bracket may be positioned on securing member 185 and may grip, tension, and secure the head side rail 171, leg, and corresponding side rail in a manner substantially similar to that disclosed above regarding FIGS. 6C-6E. More particularly, FIG. 7F depicts the direction $D^2$ in which force may be placed on the securing bracket such that slots are concurrently gripped and concertedly tensioned in a direction $D^3$ towards the leg 181 by the first and second ends of the securing bracket 191 to further securely fasten the separate side rails to the leg.

Upon assembling each side rail to the plurality of legs in the manner discussed above and in further view of FIGS. 4 and 8, support beam 195 may be securely attached between and to the head side rail 171 and foot side rail 161 to provide further structural support and rigidity to the bed frame assembly and to further support a mattress when positioned on the fully assembled bed frame assembly. In certain aspects and as further shown in FIGS. 4 and 8, support beam 195 may have a "T" shaped configuration when viewed in cross-section, and both the foot side rail 161 and head side rail 171 may include linear slots formed mid-span along their length that are axially aligned with one another when the bed frame assembly is assembled. To secure the support beam to the foot side rail 161 and head side rail 171, the support beam (having a "T" shaped conformation) may be advanced into each of the slots positioned mid-span along the foot side rail 161 and head side rail 171 until the upper portion of the support beam is substantially flush and rests on portions of the foot side rail 161 and head side rail 171. In this aspect, the support beam 195 is completely positioned and secured within the interior of the bed frame assembly when fully assembled.

In certain aspects, also disclosed is a kit comprising the above discussed bed assembly. In certain aspects, the kit may only include the headboard(s), slip cover(s), bed frame assemblies, and/or any combination thereof.

In certain aspects, the kit may further include a mallet, fastening tool(s), and/or fasteners that are configured to fasten the side rails, legs, support beam, and/or securing bracket(s) to one another when assembling the bed frame assembly.

The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

PARTS LIST

Bed Assembly 100
Headboard 110
Top/Upper End 112
Bottom/Lower End 114
Front 116
Back 118
Left Side 120
Through holes (on Left Side) 121
Right Side 122
Through holes (on right Side) 123
Outer Covering 124
130 Slip Cover (configured to be advanced in direction $D^1$ from top to the bottom of head board and secured on the bottom of the headboard)

Through holes 131, 133 that align with headboard through holes 121, 123 respectively

135 Fastening Mechanism/Zipper

137 Pocket (that conceals portions of the fastening mechanism)

Bed frame assembly 140 comprising:

141 Left Side Rail configured to be secured between two legs (one at foot of bed frame assembly and one at head of bed frame assembly)

First end 142

Linear Slot 144 positioned internal along the length of the left side rail but adjacent to the first end 142

Second end 145

Linear Slot 146 positioned internal along the length of the left side rail but adjacent to the second end 145

151 Right Side Rail

First end 152

Linear Slot 154 positioned internal along the length of the left side rail but adjacent to the first end 152

Second end 155

Linear Slot 156 positioned internal along the length of the left side rail but adjacent to the second end 155

161 Foot Side Rail configured to be secured between two legs (both legs at foot of bed frame assembly)

First end 162

Linear Slot 164 positioned internal along the length of the left side rail but adjacent to the first end 162

Second end 165

Linear Slot 166 positioned internal along the length of the left side rail but adjacent to the second end 165

171 Head Side Rail configured to be secured between two legs (both legs at head of bed frame assembly)

First end 172

Linear Slot 174 positioned internal along the length of the left side rail but adjacent to the first end 172

Second end 175

Linear Slot 176 positioned internal along the length of the left side rail but adjacent to the second end 175

Plurality of Legs, Each Leg 181 being substantially identical

First Side 182 (configured to securely attach to a side rail)

Second Side 183 (configured to securely attach to a side rail)

Securing member 185 Positioned on a corner of each leg between the first and second sides 182, 183 that are configured to securely attach to a side rail (Securing member 185 can be a dowel rod friction fitted within on opening on the corner of the leg; dowel may be threaded on one end such that a bracket may be affixed thereon by advancing a fastener (e.g., a nut) in a direction towards the leg/towards the exterior of the bed assembly when assembled).

Plurality of Securing Brackets, Each Bracket 191 having a First end 192 and opposing send end 193 formed as hooks that are configured to be fitted within vertical slots and a through hole 194 configured to receive the securing member 185 there through such that the bracket may be biased/tension in a direction towards the leg to further secure each side rail to each corresponding leg

195 Support Beam configured to be securely attached to the head side rail 171 and foot side rail 161

300 Headboard Packaging Wrapper

What is claimed is:

1. A bed assembly comprising:

(a) a foam headboard having a protective outer covering positioned thereon;

(b) one or more slip covers configured to be positioned on the foam headboard, each slip cover having a releasable fastening mechanism to temporarily securely position the slip cover on the foam head board and having a pocket that conceals portions of the fastening mechanism when the slip cover is positioned on the foam head board; and (c) a bed frame assembly, the bed frame assembly comprising:

(i) a plurality of legs, each leg having a first side and second side that are each configured to securely attach to separate side rails of a plurality of side rails and each leg having a securing member positioned on a corner of the leg between the first side and second side of the leg that extends away from the leg towards the interior of the bed frame assembly when assembled;

(ii) the plurality of side rails that are configured to be positioned and securely fastened between two separate legs of the plurality of legs;

(iii) a plurality of securing brackets, each bracket configured to be positioned on the securing member of each leg, to concurrently grip two separate side rails, and to securely fasten the separate side rails to the leg by biasing the securing bracket in a direction towards the exterior of the bed frame assembly when assembled; and (iv) a support beam configured to be completely positioned within the interior of the bed frame assembly between two separate side rails when the bed frame assembly is assembled to provide support and rigidity to the bed frame assembly and to further support a mattress when positioned on the assembled bed frame assembly, wherein:

the polyurethane foam is at least one of a castable polyurethane or a thermoplastic polyurethane with the proviso that a millable polyurethane is not present;

the polyurethane foam is either a closed cell or open cell foam;

the polyurethane foam has an R-value as a measure of hardness ranging from 1.6 lbs. per cubic foot to 2.1 lbs. per cubic foot at ambient conditions;

the polyurethane foam comprises a compression modulus ranging from 75 lbs. to 80 lbs at ambient conditions;

the polyurethane foam comprises a cell density ranging from 1.6 to 1.8 cells/cm$^3$ ($\times 10^{10}$); and the foam head board has two spaced apart ends with a plurality of through holes arranged on each of the two spaced apart ends, each through hole of the plurality of through holes are configured to align with and receive posts attached to and extending away from the bed frame assembly therein to securely affix the foam head board to the bed frame assembly.

2. The bed assembly of claim 1, wherein the polyurethane foam is a closed cell polyurethane foam.

3. A kit comprising the bed assembly of claim 1.

4. The kit of claim 3, further comprising a mallet and/or fastening tool.

5. A headboard assembly comprising:

(a) a foam headboard having a protective outer covering positioned thereon; and (b) one or more slip covers configured to be positioned on the foam headboard, each slip cover having a releasable fastening mechanism to temporarily securely position the slip cover on the foam head board and having a pocket that conceals portions of the fastening mechanism when the slip cover is positioned on the foam head board, wherein:

the polyurethane foam is at least one of a castable polyurethane or a thermoplastic polyurethane with the proviso that a millable polyurethane is not present;

the polyurethane foam is either a closed cell or open cell foam;

the polyurethane foam has an R-value as a measure of hardness ranging from 1.6 lbs. per cubic foot to 2.1 lbs. per cubic foot at ambient conditions;

the polyurethane foam comprises a compression modulus ranging from 75 lbs. to 80 lbs at ambient conditions;

the polyurethane foam comprises a cell density ranging from 1.6 to 1.8 cells/$cm^3$ ($\times 10^{10}$); and the foam head board has two spaced apart ends with a plurality of through holes arranged on each of the two spaced apart ends, each through hole of the plurality of through holes are configured to align with and receive posts attached to and extending away from the bed frame assembly therein to securely affix the foam head board to the bed frame assembly.

6. The headboard assembly of claim 5, wherein a slip cover of the one or more slip covers comprises two spaced apart ends with a plurality of through holes arranged on each of the two spaced apart ends of the slip cover with each through hole of the plurality of through holes of the slip cover configured to align with each through hole of the foam head board such that posts attached to and extending away from the bed frame assembly therein to securely affix the foam head board to the bed frame assembly.

* * * * *